US009545815B2

(12) United States Patent
Kiceniuk

(10) Patent No.: US 9,545,815 B2
(45) Date of Patent: Jan. 17, 2017

(54) METHOD AND APPARATUS FOR THE APPLICATION AND STORAGE OF SURFACE COATING MATERIALS

(71) Applicant: Taras Kiceniuk, Santa Paula, CA (US)

(72) Inventor: Taras Kiceniuk, Santa Paula, CA (US)

( * ) Notice: Subject to any disclaimer, the term of this patent is extended or adjusted under 35 U.S.C. 154(b) by 31 days.

(21) Appl. No.: 14/511,176

(22) Filed: Oct. 10, 2014

(65) Prior Publication Data

US 2016/0101646 A1 Apr. 14, 2016

(51) Int. Cl.
*B44D 3/12* (2006.01)
*B44D 3/14* (2006.01)
*A45F 5/00* (2006.01)

(52) U.S. Cl.
CPC ..... *B44D 3/126* (2013.01); *A45F 5/00* (2013.01); *B44D 3/121* (2013.01); *B44D 3/127* (2013.01); *B44D 3/14* (2013.01)

(58) Field of Classification Search
CPC ..... B44D 3/14; B44D 3/121; B44D 3/126; B05C 17/0245
USPC ..... 220/476, 480, 482, 657, 697, 735, 694,220/736; 206/216, 349, 361; 248/690, 322, 339
See application file for complete search history.

(56) References Cited

U.S. PATENT DOCUMENTS 2,659,917 A 11/1953 Drum
2,988,767 A 6/1961 Tretwold
3,283,971 A 11/1966 Jones
3,351,970 A 11/1967 Engh
3,425,012 A 1/1969 Gottinger
3,536,285 A 10/1970 Vaughn
3,729,158 A * 4/1973 Nagy ..... B44D 3/123 248/110
3,997,092 A 12/1976 Pogwizd
4,101,046 A 7/1978 Puntillo
4,122,973 A 10/1978 Ahfrn
4,205,411 A 6/1980 Cupp
4,297,762 A 11/1981 Crysdale
4,363,433 A 12/1982 Jaques
4,746,042 A 5/1988 King
4,860,891 A 8/1989 Biggio
4,928,843 A 5/1990 Gunderson
4,964,601 A 10/1990 Dishman
4,991,803 A * 2/1991 Buder ..... B44D 3/123 248/113
5,007,553 A 4/1991 Curtis
5,033,704 A 7/1991 Kerr
5,046,749 A 9/1991 Owens
D321,070 S 10/1991 Lewicki
5,083,733 A 1/1992 Marino
5,156,411 A 10/1992 Owens
5,201,439 A 4/1993 Davies
5,207,348 A 5/1993 Fischer
(Continued)

*Primary Examiner* — Robert J Hicks
*Assistant Examiner* — Kareen Thomas

(57) ABSTRACT

A method and apparatus are described for the improved application, transportation, and storage of surface coating materials including: paints, stains, cleaners, and preservatives; the present method employs a carrying and storage container in conjunction with a sealing lid; with the lid in place liquid coating materials and wet tools can be stored for extended periods of time between coating application jobs without the need to empty the container or wash out the tools; both magnetic means and selective enclosure are taught by the present invention for effective wet tool storage, whereby eliminating washing up saves time and coating products, as well as conserving wash up supplies.

38 Claims, 22 Drawing Sheets

(56) References Cited

U.S. PATENT DOCUMENTS

| | | | | | |
|---|---|---|---|---|---|
| 5,276,943 | A | | 1/1994 | Ludy | |
| 5,283,928 | A | | 2/1994 | Linn | |
| D353,241 | S | | 12/1994 | Breen | |
| D355,287 | S | | 2/1995 | Camp, Jr. | |
| 5,400,916 | A | | 3/1995 | Webber | |
| 5,402,910 | A | | 4/1995 | Pilney | |
| D361,183 | S | | 8/1995 | Pilney | |
| 5,493,751 | A | | 2/1996 | Misiukowiec | |
| 5,511,279 | A | | 4/1996 | Ippolito | |
| 5,526,952 | A | * | 6/1996 | Green | H02G 3/14 220/241 |
| 5,549,216 | A | | 8/1996 | Scholl | |
| 5,636,416 | A | * | 6/1997 | Anderson | B65F 1/06 220/495.11 |
| 5,641,087 | A | | 6/1997 | Moffitt | |
| 5,695,098 | A | | 12/1997 | King | |
| 5,746,346 | A | | 5/1998 | Crilly | |
| 5,791,608 | A | | 8/1998 | Nielsen | |
| 5,799,819 | A | | 9/1998 | Nimer | |
| 5,810,196 | A | | 9/1998 | Lundy | |
| 5,836,043 | A | | 11/1998 | Rovas | |
| 5,842,253 | A | | 12/1998 | Ahl | |
| D415,864 | S | | 10/1999 | Axhmre | |
| 6,041,919 | A | * | 3/2000 | Adams | A45D 34/046 206/15.2 |
| 6,138,963 | A | | 10/2000 | Malvasio | |
| 6,190,075 | B1 | * | 2/2001 | Lewis | A46B 11/0006 401/126 |
| D438,680 | S | | 3/2001 | Cogdill | |
| 6,260,730 | B1 | | 7/2001 | Fellman | |
| 6,283,345 | B1 | | 9/2001 | Butschat | |
| 6,431,392 | B1 | | 8/2002 | Eisenbeisz | |
| D477,702 | S | | 7/2003 | Kohn | |
| 6,769,136 | B1 | | 8/2004 | Martelly | |
| 6,929,225 | B1 | | 8/2005 | Kent | |
| 6,945,440 | B1 | | 9/2005 | Ford | |
| 6,991,829 | B2 | | 1/2006 | Bergman | |
| 7,137,168 | B2 | | 11/2006 | Mann | |
| D546,514 | S | | 7/2007 | Byrne | |
| 2002/0117592 | A1 | | 8/2002 | Traylor | |
| 2003/0015538 | A1 | * | 1/2003 | Lassiter | B65D 81/3876 220/592.18 |
| 2003/0233719 | A1 | | 12/2003 | Wolfinger | |
| 2005/0156085 | A1 | | 7/2005 | Radovan | |
| 2007/0285824 | A1 | | 12/2007 | Cornelissen | |
| 2011/0290803 | A1 | * | 12/2011 | Kehres | E04F 21/02 220/475 |

* cited by examiner

Section B-B

METHOD AND APPARATUS FOR THE APPLICATION AND STORAGE OF SURFACE COATING MATERIALS

RELATED PRIOR APPLICATIONS

This is a divisional application based on Application US 20120037634 A1

Publication number US 20120037634 A1 Publication type Application

Application U.S. Ser. No. 13/135,382 Publication date Feb. 16, 2012

Filing date Jun. 30, 2011 Priority date Aug. 16, 2010 Also published as CN102423992A U.S. Provisional patent ID No. 61/401,612 filed on date Aug. 16, 2010 is referenced for a priority date.

U.S. Design Pat. No. D643,983 S1, published on Aug. 23, 2011 is a related design patent to the present invention.

FIELD OF INVENTION

The present invention relates to the field of surface coating application and storage. The methods and apparatus in this field frequently employ: buckets, paint trays and other hand-carried containers for liquids and tools. In particular, the present invention provides improvements for the carrying, applying and storage of paint along with associated preparation and application tools.

BACKGROUND OF INVENTION

The standard horizontal paint roller tray, and application methods using one, have remained in wide use despite many inventions directed at improving the worker's access to surface coating material and at providing a roller paint distributing or spreading surface in convenient proximity to a stable paint-holding reservoir. Various covers have been made for paint trays allowing material storage. Putting the tray in a plastic bag along with tools is a known method for between job storage of tools and supplies.

Some of the impetus for the present invention comes from the various shortcomings of the standard horizontal roller pan.

The problems with the standard pan include: lack of stability when used on a ladder; small paint capacity; and lack of portability. The instability experienced while a horizontal roller tray is carried has been demonstrated over the years and is known to all those skilled in the art of roller painting. Using a roller tool and a brush on the same job generally requires multiple paint containers, leading to clutter and lack of portability. A significant need exists for a more ergonomic alternative to the prevalent prior art. Washing of tools is a time-consuming task that requires large amounts of water or other solvents and wastes material. These problems are addressed by the method and apparatus of the present invention.

From the year 1953, U.S. Pat. No. 2,659,917 by Drum teaches an improved surface for distributing paint on a roller for a horizontal paint tray. Drum provides a textured drainable surface where excess paint can be removed from the roller.

Currently it is common practice for people who paint with a roller to use a porous paint screen in a bucket, or to use a standard roller tray. Various specialty buckets are available which offer substantially vertical roller paint distributing elements. Several patents for such devises are listed below as well as other relevant prior art.

From 1961, U.S. Pat. No. 2,988,767, A. Tretwald, et al. teach a bucket with a flat vertical section on the inside to distribute paint on a paint roller.

From 1967, U.S. Pat. No. 3,351,970 by Engh, teaches a paint container with a substantially vertical paint distributing surface. Engh teaches the use of a shoulder strap, a bail handle and a means of attaching the container to the front of a ladder. The Engh tray may be used in a horizontal or vertical position.

From 1969, U.S. Pat. No. 3,425,012, Gottinger teaches the use of a magnet for securing a paintbrush to the side of a metal paint can.

From 1970, U.S. Pat. No. 3,536,285, Vaughn uses magnetic means for holding a paintbrush.

In U.S. Pat. No. 3,997,092 (1976), Pogwizd shows a harness and provisions for holding a brush and a paint scraper. Pogwizd also teaches the use of a pivoting lid.

In U.S. Pat. No. 4,101,046 (1978), Puntillo uses a magnet to suspend a paintbrush over a paint can.

From 1990, U.S. Pat. No. 4,964,601, Dishman discloses the use of elastic bands to attach a paint container to the side of a ladder.

From 1989, U.S. Pat. No. 4,860,891, Viggio discloses a paint and brush holder that incorporates a rear handle and, in front, a horizontal brush-grooming ledge.

In U.S. Pat. No. 5,046,749 (1991), Owens describes a paint-holding container where two of the vertical sides provide means of distributing paint on a paint roller.

In U.S. Pat. No. 5,928,843, Gunderson describes an invention which uses the lid of a paint container in a relocated vertical position to distribute paint on a roller.

In U.S. Pat. No. DES.321,070, Lewicki shows the ornamental design for a paint tray holder with paint roller support.

In U.S. Pat. No. 5,156,411, Owens teaches the use of a vertical roller surface in conjunction with a paint splatter shield.

In Fischer, et al, U.S. Pat. No. 5,207,348, the inventors describe an insert for a five-gallon bucket which includes a textured paint roller surface.

In U.S. Pat. No. 4,746,042, King provides a holder for a wet paintbrush that is worn on the user's belt.

From 1992, in U.S. Pat. No. 5,083,733 Marino, et al describe a brush holder incorporating a plurality of magnets.

In the 1990s a vertical roller paint tray with a rear-sided outward then downward protruding flange was sold in the country of Argentina. This container also incorporated a slanted open top, tallest in back, and a flexible cord handle, as well as horizontal striations in the rear wall. This container had rectangular plan-form shape, most narrow front to back with square corners; it was proportioned to work with a standard full-size paint roller.

In U.S. Pat. No. 5,033,704, Kerr teaches a magnetic brush holder incorporating a horizontal shelf.

In U.S. Pat. No. 5,276,943, Ludy discloses a handle for a paint can that facilitates suspending the can from a ladder.

In U.S. Pat. No. 5,201,439, Davies discloses a paint tray that can function with the roller paint-distributing surface oriented either horizontally or vertically. Davies also teaches the use of a roller-holding clip or notch.

In U.S. Pat. No. 5,402,910 Pilney discloses a paint container which can hang from the rungs of a ladder. His invention incorporates vertical roller paint-spreading surfaces, and a sealing lid is provided.

Ippolito, in U.S. Pat. No. 5,511,279, describes a stackable paint roller pan that has an enlarged one-quart capacity and an adjustable one-hand carrying handle.

Weber, in U.S. Pat. No. 5,400,916, describes a paint roller bucket which includes a steeply inclined roller paint distributing surface as well as a pivoting bail handle and a pour spout.

In U.S. Pat. No. 5,493,751, Misiukowiec et al describe a paint pan which can hang on the rung of a ladder and has a vertical roller paint distributing surface. The invention provides a lid, and is designed to function also in a substantially horizontal position.

King, U.S. Pat. No. 5,695,098, discloses a belt- or strap-supported holder for a wet paint brush or roller.

Moffitt, U.S. Pat. No. 5,641,087, presents a paint bucket for a mini-roller which includes a central wedge-like structure comprising two nearly vertical roller paint distributing surfaces.

Scholl, U.S. Pat. No. 5,549,261, describes a paint holder and delivery device which includes a removable, but non-disposable, liner.

From 1998, U.S. Pat. No. 5,746,346, Crilly describes a paint carrier which incorporates a non-magnetic brush holder on the inside of the paint-holding container.

Lundy, U.S. Pat. No. 5,810,196, describes a paint bucket which incorporates a brush-holding recess and a porous, inclined roller paint-distributing grid.

Ahl, et al, in U.S. Pat. No. 5,842,253, describe a ladder-supported paint-holding tray with notches for supporting a paint roller.

Rovas, in U.S. Pat. No. 5,836,043, teaches a paint tray with a specialized bail handle that enables the container to hang from the rungs of a ladder and also to be used flat on a horizontal surface.

Kohns, U.S. Pat. No. D477,702 S, discloses the ornamental design for a paint bucket with a bail handle and a substantially vertical roller paint distributing textured surface.

Malvasio, U.S. Pat. No. 6,138,963, describes a paint cup and brush holder incorporating a handle and pour spout. It is molded to provide for relatively compact stackability.

Butschat, U.S. Pat. No. 6,283,345 B1, describes a paint container system which can be worn on the user's belt and includes a means of holding a wet brush within the container.

Eisenbelsz, U.S. Pat. No. 6,431,392 B1, describes a detachable handle mechanism for carrying a conventional paint roller tray pan.

Fellman, U.S. Pat. No. 6,260,730 B1, describes an insert for a standard paint bucket, which provides a substantially vertical roller paint distributing surface.

Byrne, U.S. Pat. No. D546,514 S, describes the ornamental design for a paint bucket that includes a substantially vertical roller paint distributing surface.

Bergman, U.S. Pat. No. 6,991,829 B2, describes a hand-held vessel for holding paint which incorporates an adjustable handle as well as a brush-holding magnet.

Martelly, U.S. Pat. No. 6,769,136 B1, teaches the use of an apron and a paint container in combination.

Kent, U.S. Pat. No. 6,929,225 B1, describes a clip with a brush-holding magnet for use on the side of a paint container.

Ford, U.S. Pat. No. 6,945,440 B1, describes a paint bucket which has a hinging lid and a flexible strap.

OBJECTS OF THE PRESENT INVENTION

A primary object of the present invention is to provide painters with convenient and ergonomic method and means of transporting, storing, and applying surface coating materials.

A primary object of the invention is to provide a secure sealing lid, which can be equipped with a notch that allows the handle of a paint roller tool to protrude from the container while the paint-wet portion of the roller tool is protected from drying out within the container.

A further object of the invention is to provide a moveable flap, which can be used to seal the notch hole in the lid when no paint roller tool handle is in place.

A primary object of the invention is to provide temporary means of supporting a paintbrush or similar tool within the container, such that its handle is above the level of the liquid paint. It is a further object of the present method and apparatus to store a brush inside while the sealing lid is in place, forming a containing assembly.

A further object of the present invention is to provide magnetic means of holding a paintbrush or multiple brushes in a secure position within the container, which enables them to drain excess paint back into the container.

An additional object of the invention is to provide a bi-functional means of simultaneously securing tools on either side of a magnet located within a wall of the container.

A further object is providing specific means for carrying a plurality of paint-spreading, repair and clean-up tools. The present invention is intended to facilitate effective dispensing, storage and applying of paint and other coating materials.

An object of the invention is to provide an outward—then downward-turning flange that encircles the top opening of the container; the flange with its holes and lobes can receive, store and transport a plurality of tools and supplies.

An object of the invention is to provide specialized holes and magnetized receptacles for receiving tools and supplies. The tools for which receptacles are provided can include, but are not limited to: paint rollers, paint brushes, paint scrapers, cleaning cloths, putty knives, screwdrivers, standard pencils, carpenter's pencils and tape measures.

An object of the invention is to provide a cloth-holding receptacle, or a plurality thereof, that can be comprised in the tool-holding flange, thereby providing convenient means of storing a cloth for clean-up purposes.

A further object of the invention is to provide for compact, jam-proof stackability, for storage and transportation of multiple containers.

Another object of the invention is to provide a novel easily-detachable shoulder strap which stays in place on the operator with or without a container attached.

Such a strap enables the operator to have hands free while using the invention to carry supplies and tools. This feature can be found helpful when working on a ladder.

A further object of the invention is to provide a container and tool holder which can be enclosed or stored entirely within a standard five-gallon paint bucket and lid.

A further object of the invention is to provide an outward and downward-turning flange around the top of the container, said flange being suitable for holding a plurality of tools.

Another object of the invention is to provide an angle on the open top of the container to allow easier access to its contents.

An additional object of the invention is to provide a replaceable liner for the container, where the liner can extend over and around the top sealing lip of the container, enabling the sealing lid to function approximately normally with or without a liner in place.

An additional object is to provide means of holding a porous paint spreader screen within the container which can provide stable means of effectively distributing paint on a roller; and where the screen will not interfere with installation of a sealing lid.

A further object of the invention is to provide multiple means of supporting the invention while in use, comprising means of resting on horizontal surfaces and means of hanging from ladders, knobs, shelves, ledges, cabinet doors, chair backs, etc.

An additional object of the invention is to provide retractable legs that provide additional stability for the invention when it is resting on a horizontal surface, but which can be folded away when the container is suspended from a ladder, carried, or the like.

An additional object of the invention is to provide a multi-position bail handle, which engages a stop and produces an ergonomic two-element handhold in conjunction with the invention's back flange.

An additional object of the invention is to provide a tool-holding slot in proximity to a magnet; the combination can securely hold a paint-scraping tool or putty knife.

An additional object of the invention is to provide means of holding painter's putty or the like.

An additional object of the invention is to provide means of holding a clip-on tool such as a tape measure, or a clip-on tool pouch capable of holding additional tools or accessories.

Another objective is to create an apparatus that is inexpensive to manufacture by being molded from plastic.

SUMMARY OF THE INVENTION

The present invention of a Method and Apparatus for the Application and Storage of Surface Coating Materials provides convenient and ergonomic method and means of carrying and using a liquid such as paint and/or a plurality of tools within a work or hobby environment. An embodiment is disclosed that can hold a quantity of paint as well as a variety of tools, which may be used in conjunction with the paint. A versatile handle can be provided, enabling the container to be comfortably carried and used with various different hand positions. An optional detachable shoulder strap is disclosed, which allows the user to transport the container while having have both hands free for other needs. The container can be configured to hang securely on the side of a ladder as well as rest stably on a horizontal surface. A special rear flange can provide means of supporting the container on a cupboard door, chair, drawer, or doorknob. The apparatus of the present invention has proven itself to be useful in various activities that require a small collection of tools and materials, as well as in the primary tasks of painting and paint preparation. The method of the present invention has proven to be a superior way to apply and store surface coating materials.

DETAILED DESCRIPTION OF PREFERRED EMBODIMENTS

Exemplary preferred embodiments of the present invention are disclosed herein with reference to the several drawing figures. It will be understood by one skilled in the art that the various features and elements disclosed herein may be assembled in a multitude of alternative combinations and still fall within the scope of the present invention.

This description of exemplary preferred embodiments is provided as specific examples of embodiments within a group of variations, and it will be understood that this description and disclosure is not intended to limit the scope of the invention except as specifically announced in the claims.

Description of the Apparatus of the Present Invention:

The present invention provides an improved apparatus for applying and storing surface coating materials, whereby surface coating material may be efficiently stored and applied to diverse surfaces over a period of time without having to remove the coating material from the container or having to wash application tools, thereby saving time and materials.

Figure 1:
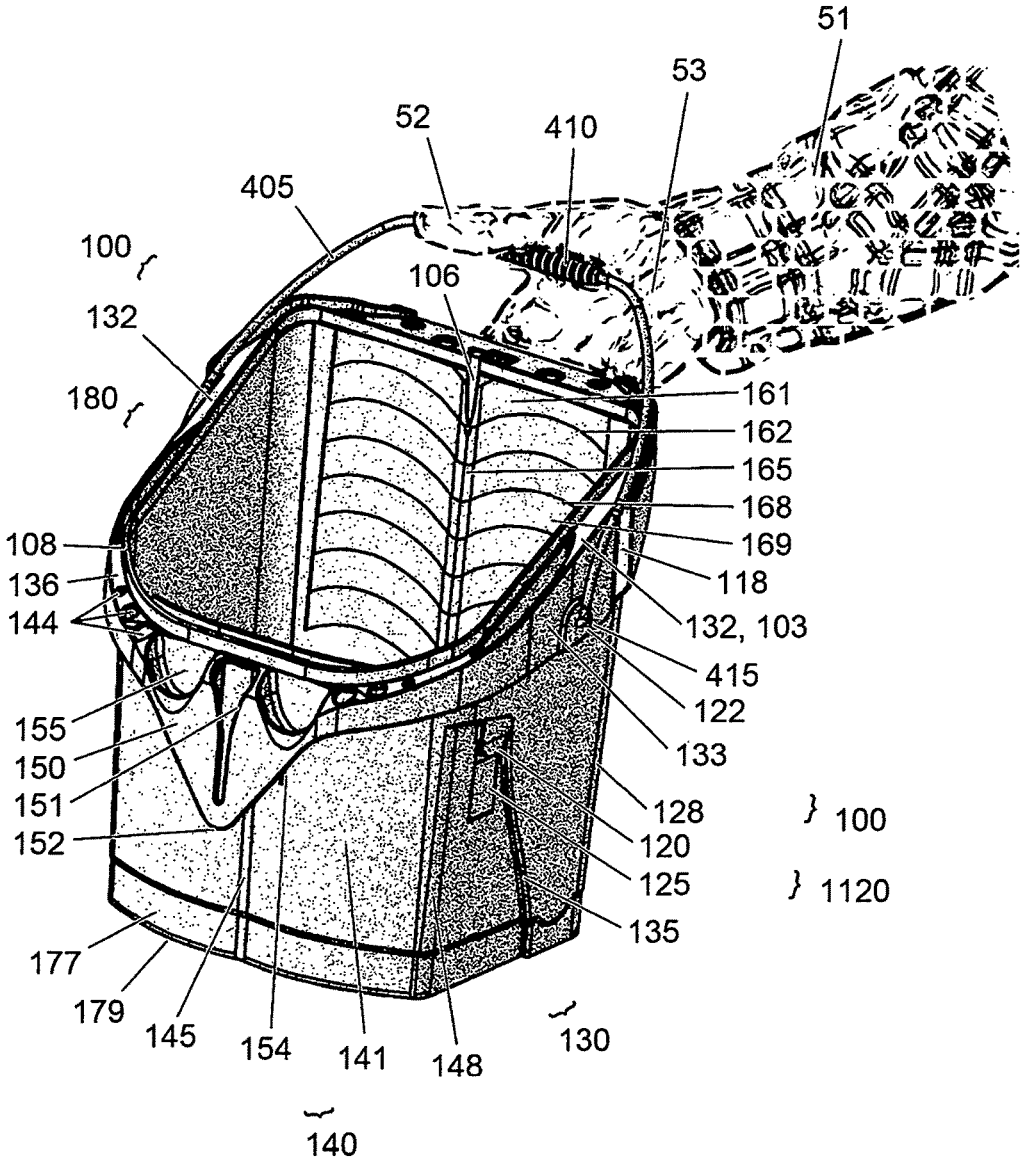
FIG. 1. Front prospective view of an operator's hand holding the container of the present invention.
Figure 2:
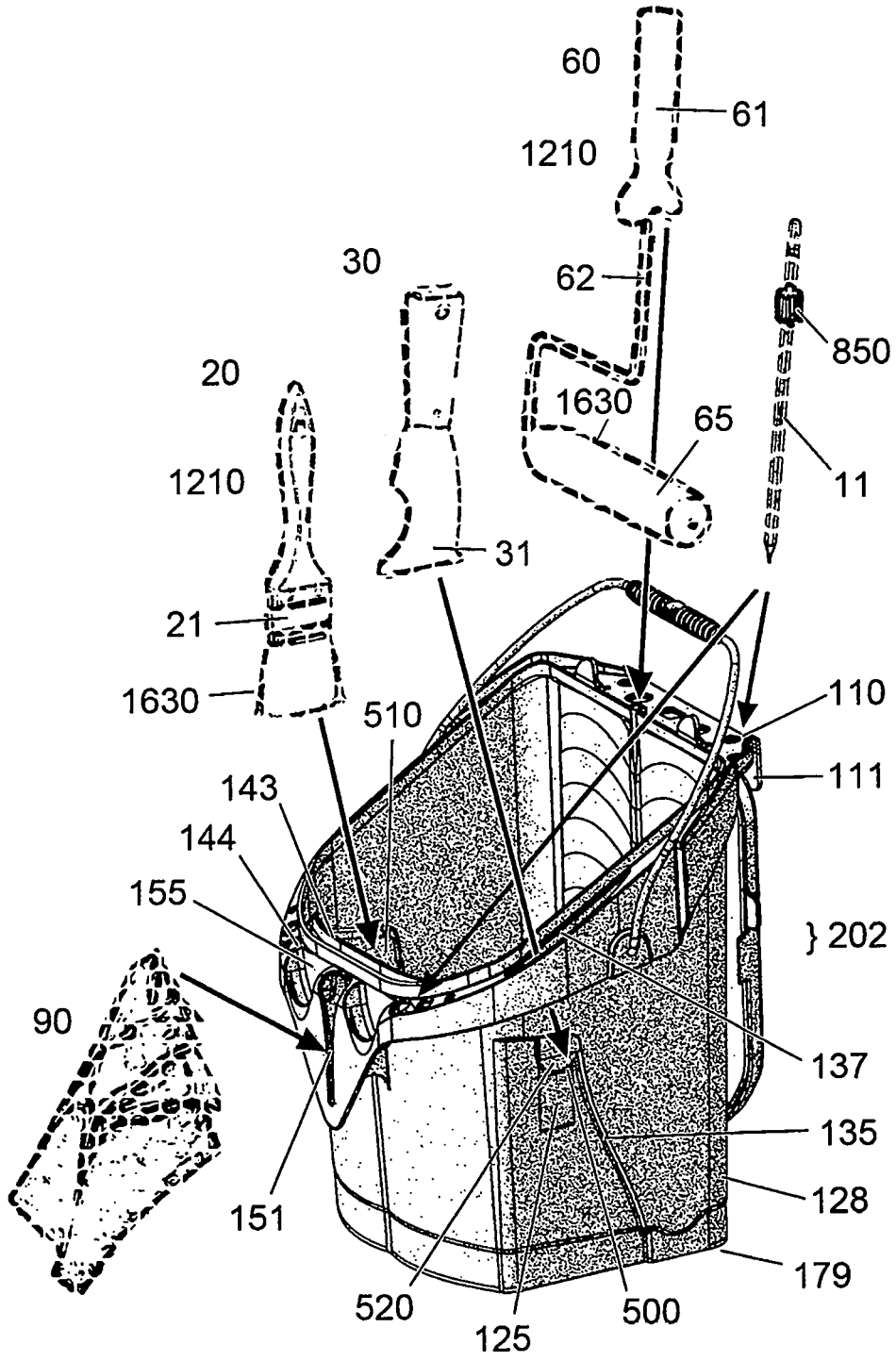
FIG. 2. Front prospective view of a portion of the apparatus of the present invention showing various associated tools and tool stowage locations.

The transportable container 100 shown in FIG. 1 can have an open top 180; the container 100 can hold a quantity of surface coating material 1110 (FIG. 16) and at least one application tool 1210 (FIG. 2). The application tool 1210 can have a handle section 1510 and a wettable section 1630, which is intended to be dipped into surface coating material 1110. Application tools 1210 include, but are not limited to: paint roller tools 60, paintbrushes 20, sponge tools, faux finish rag tools 90, spatulas 30, and paint spreading tools.

The transportable container 100 has an interior and an exterior, and a bottom part 170 that can support the container 100 in a stable manner when the container 100 sits normally on a flat and level surface. The open top 180 can be inclined to the horizontal at an angle of up to approximately 45 degrees, whereby easier access is provided to the surface coating material 1110 inside.

The present invention provides a lid 200 (FIG. 9), which can fit over the open top 180 of the transportable container 100. The lid 200 can be configured to temporarily attach to the exterior of the container in a stowage location 202 (FIG. 2), the stowage location 202 being different from the position occupied by the lid when forming a containing assembly 1620 (FIG. 11), whereby the lid 200 can be easily kept with the container 100 and it is immediately available to seal up the container 100, also when stowed 202 the lid 200 can be less likely to get misplaced or lost. The lid 200 can have extensions 230 configured to fit within receiving elements 115 on the exterior of the transportable container 100 when the lid 200 is installed in its stowage location 202 (FIG. 10).

When the lid 200 is fitted a containing assembly 1620 (FIG. 11) is formed by the joined combination of the container 100 and the lid 200. The containing assembly 1620 can be substantially vapor tight, thereby preventing drying out of any enclosed surface coating material 1110 when the assembly is stored in a suitable location 1710 for a period of time 1810. The application tool 1210 can have a handle section 61, 1510, an intermediate shaft section 62 and a wettable section 65, 1630.

The lid 200 can have a notch 206 of a predetermined size allowing through passage of the shaft section 62 of the application tool 1210 and providing a substantially vapor tight seal therewith. The wettable section 65, 1630 of the application tool 1210 can then be enclosed within the containing assembly 1620 and protected from drying out while the handle section 61, 1510 of the application tool 1210 is exterior to the containing assembly 1620. A moveable cover 300 can be provided for the notch 206, which can block the slot 206 in the lid when no tool handle shaft 62 is in the slot 206. The moveable cover 300 can provide a substantially vapor tight sealing of the containing assembly 1620, whereby surface coating material 1110 may be stored inside the containing assembly 1620 and be protected from drying out for periods of time 1810 when no tool handle shaft 62 is occupying the notch 206. The moveable cover 300 can be captive and pivot about a predetermined axis 320. Alternatively the moveable cover 300 can be captive and attached to the containing assembly 1620 by a flexible element.

Figure 11:
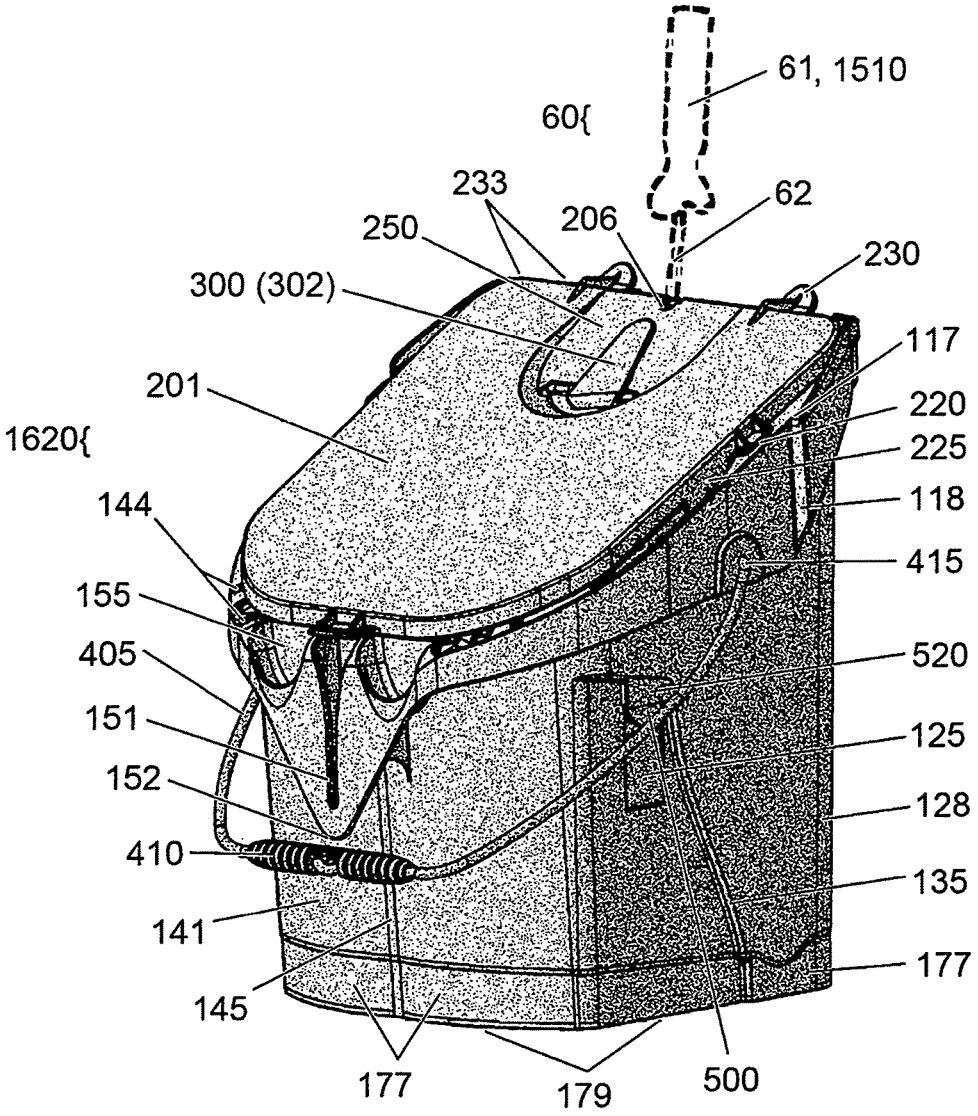
FIG. 11. A front perspective view of the main components of the apparatus of the present invention, with the lid in the closed position and a paint roller tool in storage position; the notch-sealing flap in the lid is shown open, to accommodate the roller tool handle shaft.

The present invention can provide securing means for supporting an application tool 1210 (FIG. 2) in a manner which allows the wettable section 1630 of the tool 1210 to be enclosed within the substantially vapor tight containing assembly 1620 (FIG. 11). The securing means additionally positioning the handle section 1510 of the application tool 1210 such that the handle section 1510 is clear of any surface coating material 1110, 1410 (FIG. 16) that is within the containing assembly 1620 (FIG. 11) when the assembly is sitting normally. The securing means can be magnetic means of temporarily attaching the application tool to the containing assembly 1620.

The magnetic means can comprise an individual magnetic element 500, which can be configured and placed in a region where magnetically attractable objects may be held on both the interior 510 and the exterior 520 of the container 100 by the same magnet 500, so that wet paintbrushes 20 can be held inside the container 510 and dry scraping tools 30 on the outside 520 at the same time.

Figure 23:
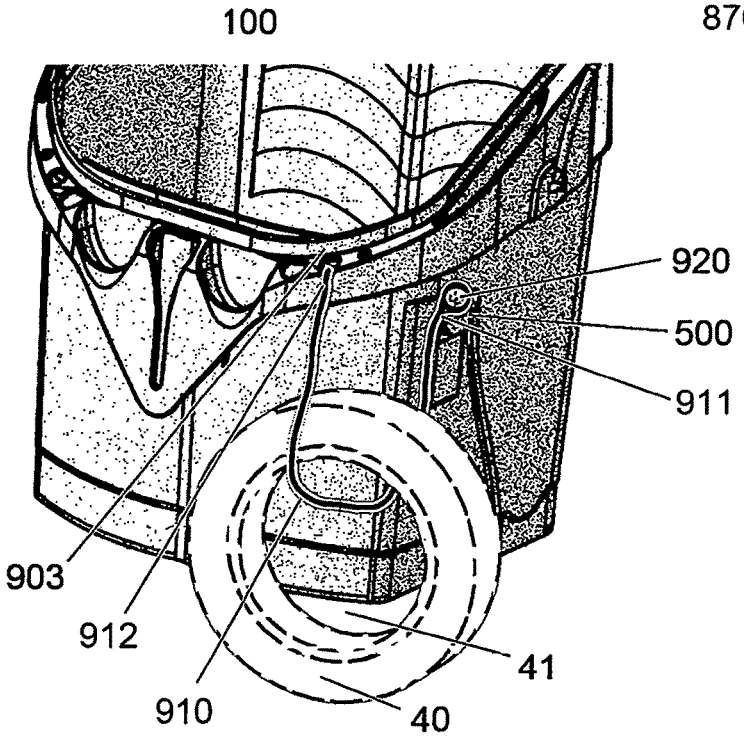
FIG. 23. A perspective view showing a preferred embodiment of a tape roll holder.

The present invention can also provide a lineal flexible element 910 (FIG. 23), which is tied to the container 100. The lineal element can terminate in a magnetically attractable section 920 that can be detachably attached to a magnetic portion 500 of the transportable container 100. The lineal flexible element 910 can have some slack when the magnetically attractable end 911 is attached to the magnet 500 on the container 100. This combination can allow a roll of tape 40 to be transported by putting the attractable end 911 of the lineal element 910 through the tape roll 40 and attaching the attractable end to the magnet 500.

Figure 5:
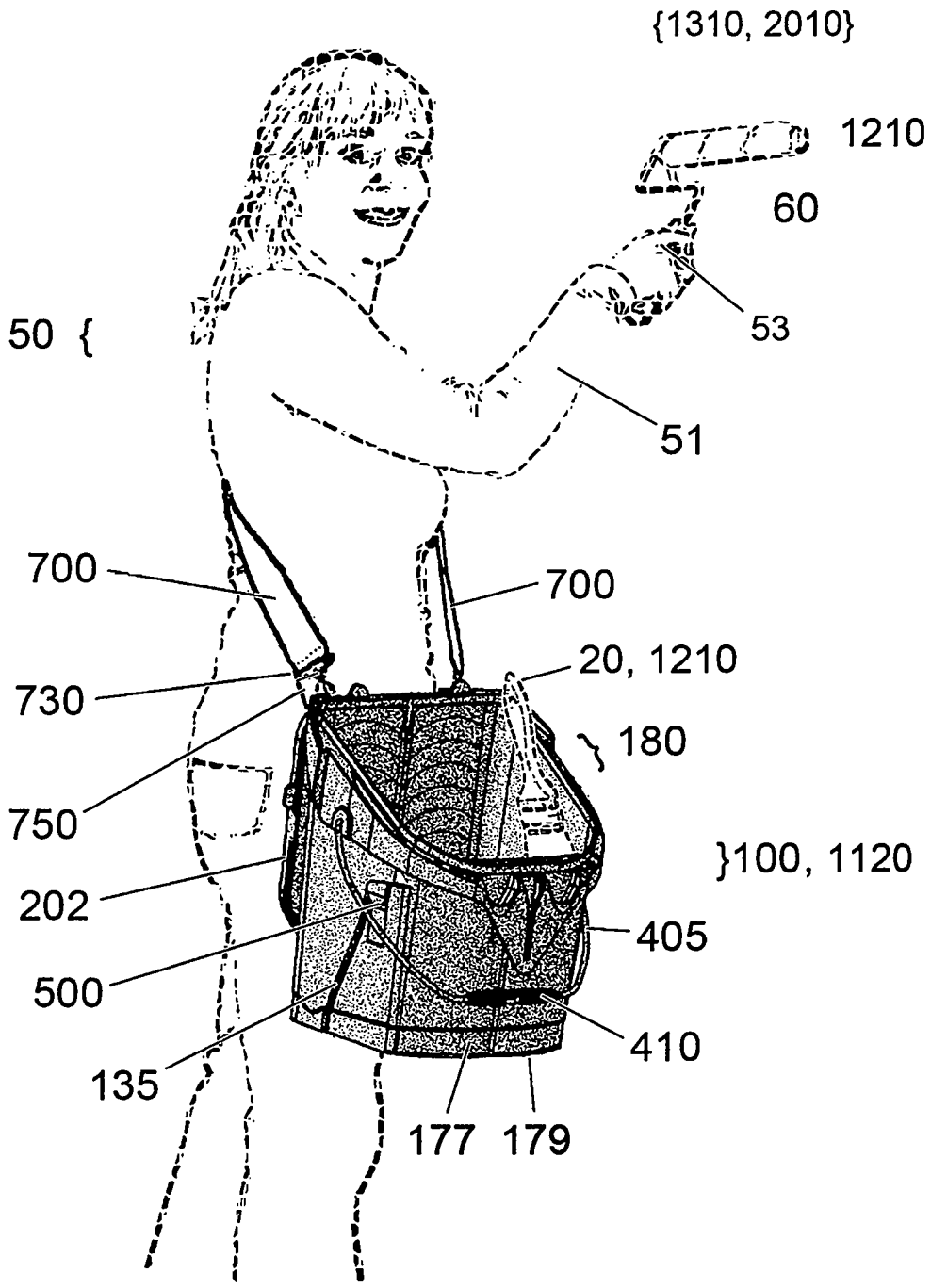
FIG. 5. Painter using a preferred embodiment of the present invention showing a preferred carrying strap configuration.

The present invention provides transporting means allowing for convenient movement of the container 100 from location to location 1220, 1710 by a person 50 (FIG. 5). The transporting means can comprise a detachable strap assembly 700 configured to temporarily attach the container 100 to a person 50, allowing the person 50 to carry the transportable container 100 without gripping it in their hands, whereby the person 50 may have hands free to use application tools, support themselves, or perform other actions. The strap assembly 700 (FIG. 6) can adjustably engage a person's neck, or shoulders, or waist, or torso, or a combination thereof, whereby depending on the nature of the job the container 100 may be attached to the person 50 in a variety of different ways.

The present invention can also provide means of temporarily attaching the transportable container 100 to a supporting element, including: ladders 66, scaffolding, chairs 68, doors, fences, knobs, hooks, and lanyards (FIG. 7, FIG. 8); thereby allowing the container 100 to be positioned and stabilized in a convenient position when in use. The means of temporarily attaching the transportable container 100 to the supporting element can comprise: hooks 80, clips 82, and flange extensions 110,111 of predetermined shape.

The present invention can also provide a liner 800 (FIG. 18) installed 1010 in the container 100, 1120 prior to putting the surface coating material 1110 into the container 100, the liner 800 being of predetermined thickness, and being configured to allow substantially normal operation of the lid 200 and permitting formation of a containing assembly 1620 with a liner 800 installed. The liner 800 may be optionally used and removed 2110 to facilitate color change or clean out. The liner 800 can be constructed of thin flexible plastic material of a thickness between approximately 0.002" and 0.012". The thickness being sufficiently thick to resist puncture in normal use, yet sufficiently thin to fit between the container and the lid when a containing assembly 1620 (FIG. 11) is formed, thereby allowing optional use of a liner 800 with the lid 200, 1610 and the container 100, 1120 combination.

The present invention can also provide a screen or grid 70 (FIG. 4), which can be substantially planar. The grid 70 can engage the container 100 and be securely yet removably positioned proximal to a substantially planar area on the interior of the container 100. The grid 70 can fit within the containing assembly 1620 along with application tools 1210 in their secured positions. Using the grid 70, surface coating material 1110 can be easily distributed on or removed from application tools 1210. The grid 70 can be stored inside the containing assembly 1620 along with the wettable sections 1630 of application tools 1210 and any remaining coating material 1410.

The present invention can also provide a plurality of extendable legs 610, 620, 630, 640 (FIG. 13) attached to the bottom part 170 of the transportable container 100. The extended legs 610, 620, 630, 640 can give the container 100 extra stability when it is resting on a substantially flat and level surface. Each of the extendable legs 610, 620, 630, 640 can pivot about a separate substantially vertical axis (FIG. 14), whereby the legs 610, 620, 630, 640 can have good structural integrity in the vertical direction and yet pivot and fold up easily in a substantially horizontal plane.

Figure 3:
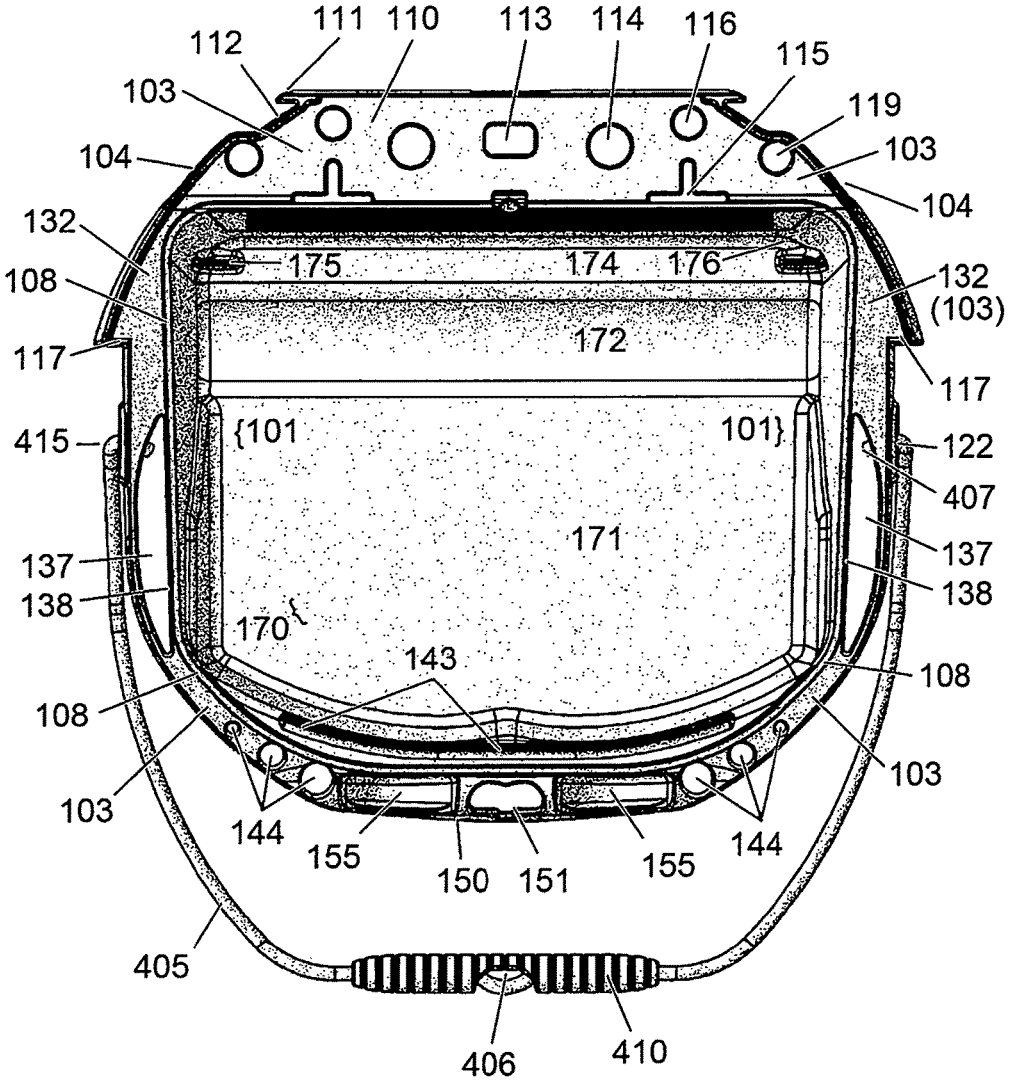
FIG. 3. Top view of a preferred embodiment of the container of the present invention showing tool stowage flange, grid support web, etc., with the handle and grip in a forward position.

The present invention can also provide a plurality of tool receiving extensions 116, 137; 144, 151 around the exterior of the container, whereby additional tools may be transported and used in conjunction with the container 100 (FIG. 3).

The present invention can also provide a tool stop toroid 850 (FIG. 22), which can be constructed of elastic material and be of predetermined size and shape, such that the tool stop 850 securely engages the shaft portion 854 of a tool. The tool stop 850 can be of sufficient size and shape to engage the tool receiving extensions 116, 144 on the transportable container 100, whereby a tool stop 850 around a tool 854 can prevent the tool 854 from sliding past the tool receiving extensions or through receiving holes 116, 144 on the container 100.

The present invention can also provide multifunctional magnetic means 500, 530, 550 (FIGS. 20, 21) for supporting an application tool 1210 in a manner that provides easy access to its handle section 1510 and allows the wettable section 1630 of the application tool 1210 to drain back into the interior 101 of the transportable container 100 when the container 100 is sitting normally. The multifunctional means can additionally provide temporary magnetic securing of magnetically attractable items on the exterior of the container 520, so that a wet application tool can be temporarily secured inside the container 510 and a dry article temporarily attached to the outside 520 by the same magnetic means 500, 550 (FIG. 2).

A wall section 130 (FIG. 20) containing multifunctional magnet means 500, 550 can form part of the transportable container 100. The multifunctional magnet means 500, 550 can comprise at least one magnet 500 incorporated into the wall section 130 of the container 100. The magnet 500 can be positioned in the wall section 130 so that magnetically attractable objects 21, 31, 920 (FIGS. 2, 23) may come in close proximity to the magnet 500 without being impeded by other material in the wall section 130, whereby being closer to the magnet 500 provides stronger magnetic attraction for the tool 31 or other item 920, and yet the magnet 500 is not exposed.

The present invention allows leftover paint and a wet tool, or a plurality thereof, to be sealed up and stored in a containing assembly 1620 (FIG. 11) for a period of time 1810 (FIG. 24) ranging from a few minutes to several months without washing the tool 1210 or container 1120.

A preferred embodiment of a portion of the present invention, as disclosed in FIGS. 1 and 2, can comprise a container unit 100 with a flange 103 around an open top 180. The flange 103 can have a plurality of tool receiving holes, pockets and slots 112, 113, 114, 116, 144, 151, 155. Special 'T' shaped slots 115 can be provided to receive corresponding tabs 230 on the lid 201.

A preferred embodiment of the present apparatus comprises: a container 100, a lid assembly 200, and means of securing coating application tools.

Some additional elements may be added to the above embodiment in order to provide additional functionality: a pivoting handle assembly 400, a paint spreading grid or screen 70, a carrying strap 700, a removable liner 800, and a tool storage collar stop 850.

In a preferred embodiment, the container 100 of the present invention can be laterally symmetrical about a vertical plane passing through the middle of the container, this provides for complete ambidextrous functionality and can contribute to providing an ergonomic conceptual simplicity.

The container 100 can be capable of holding a quantity of liquid in a reservoir area 101 and/or a plurality of tools on a flange 103. The container can have a rear substantially planar wall 160 that is oriented in a near vertical position when the container is sitting on its bottom and resting normally on a horizontal surface.

The container 100 can have an open top side 180 which is at least partially surrounded by a substantially horizontal flange 103 protruding outward from near the top edge of the open top side 180. The flange 103 can contain holes 113, 114, 116, 119, 144 and/or recesses 155 for receiving putty and holding a tool or a plurality of tools. Portions of the tool flange 103 may be substantially vertical, like the side flange 133 and the rear flange 111. The side vertical flange 133 can be configured to hold a tape measure or similar clip-on item, including among other possibilities, a tool-holding pouch.

In an exemplary preferred embodiment of the container, the top opening 180 can slope downward towards the front at an angle of approximately 30 degrees from the horizontal.

In a preferred embodiment the container 100 can comprise a lip 108 extending vertically upward around the periphery of the open top 180 when the container 100 is resting on a horizontal surface. The lip 108 can be capable of receiving a substantially sealing lid assembly 200. In contrast to the prior art for clip-on lids, the lip of the present invention may be vertical while the open top is inclined at approximately 30 degrees from horizontal. Thus removal of the lid occurs in a vertical direction 970, rather than perpendicular to the surface of the open top and lid as is found in the prior art.

The container 100 can be molded from a semi-flexible plastic such as high-density polyethylene or polypropylene, and formed with four substantially planar walls: a rear wall 160, two side walls 130; a front wall 140; as well as a bottom 170 and an angled open top 180. An outwardly protruding flange 103 can be provided around the periphery of the open top 180. A vertical, upwardly protruding lip 108 can also be provided around the periphery of the open top 180. The lip 108 can be configured to receive a sealing or semi-sealing lid assembly 200 with suitably shaped extensions 204, 203.

Radiused corners 128 of approximately ½ inch radius can be provided where the side walls 130 meet the rear wall 160. When viewed from the top (FIG. 3), the reservoir portion 101 of the container unit 100 can have a trapezoidal shape where the side walls 130 are of equal length and the rear wall 160 is longer than the front wall 140. The side walls 130 will therefore be non-parallel. This feature can provide for more compact storage within a round storage space as may be found within a standard five-gallon paint pail. A optional object of the present invention is to constrain the dimensions of the container such that the complete apparatus can be stored entirely within a closed standard five-gallon paint pail.

Figure 20:
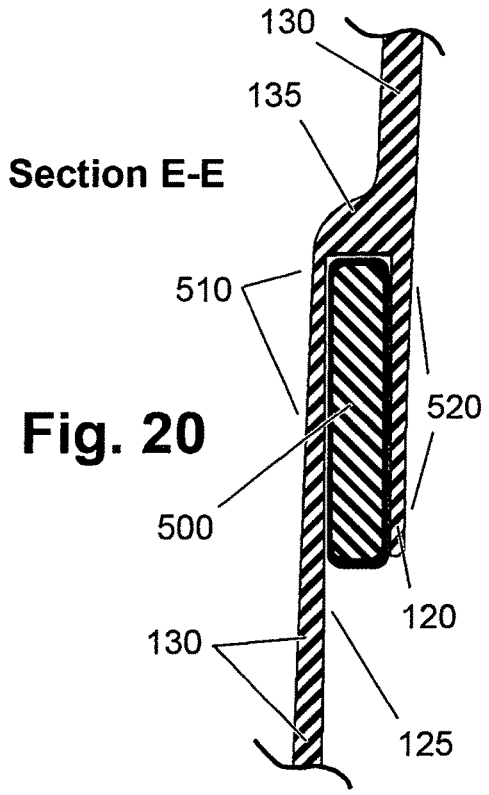
FIG. 20. A front detail cross sectional view of a magnet within a side wall of the container, taken on a vertical plane E-E in FIG. 15.
Figure 21:
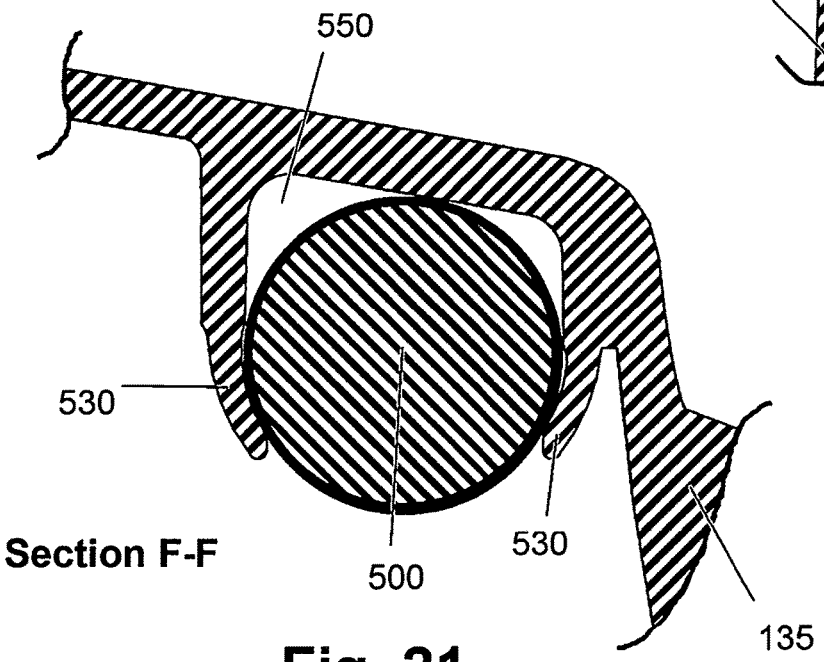
FIG. 21. A side detail cross sectional view of a magnet within a side wall of the container, taken on a vertical plane F-F in FIG. 15.

As shown in FIG. 2, the present invention provides a painter with convenient means of transporting and accessing a supply of paint and associated tools such as: a paint roller tool 60; a paint brush 20; a scraper tool 30; a pencil 11; and a wiping cloth 90. A paint roller tool 60 can be hooked on the rear lip 108 of the container 100. A paint brush 20 can be held by a magnet 500 attracted to the brush's metal band 21 near a location 510 on the interior of the container 100. By rotating the handle of the attached paintbrush rearward, a lid 200 can be used to seal the brush entirely within a containing assembly 1620 (FIG. 11). The magnet 500 can be located in a pocket 550 in the side wall 130 of the container 100 (FIGS. 20, 21). A putty knife or paint-scraping tool can be held by the combination of a magnet 500 on its outside edge 520 and an oblong hole 137 in a tool-holding flange 103 (FIG. 2). A vertical portion 133 of the tool-holding flange 103 can be provided proximal to the outer side of tool hole 137. The vertical portion 133 proximal to hole 137 provides a handy element to clip on a tape measure or a clip-on tool-holding pouch.

Figure 16:
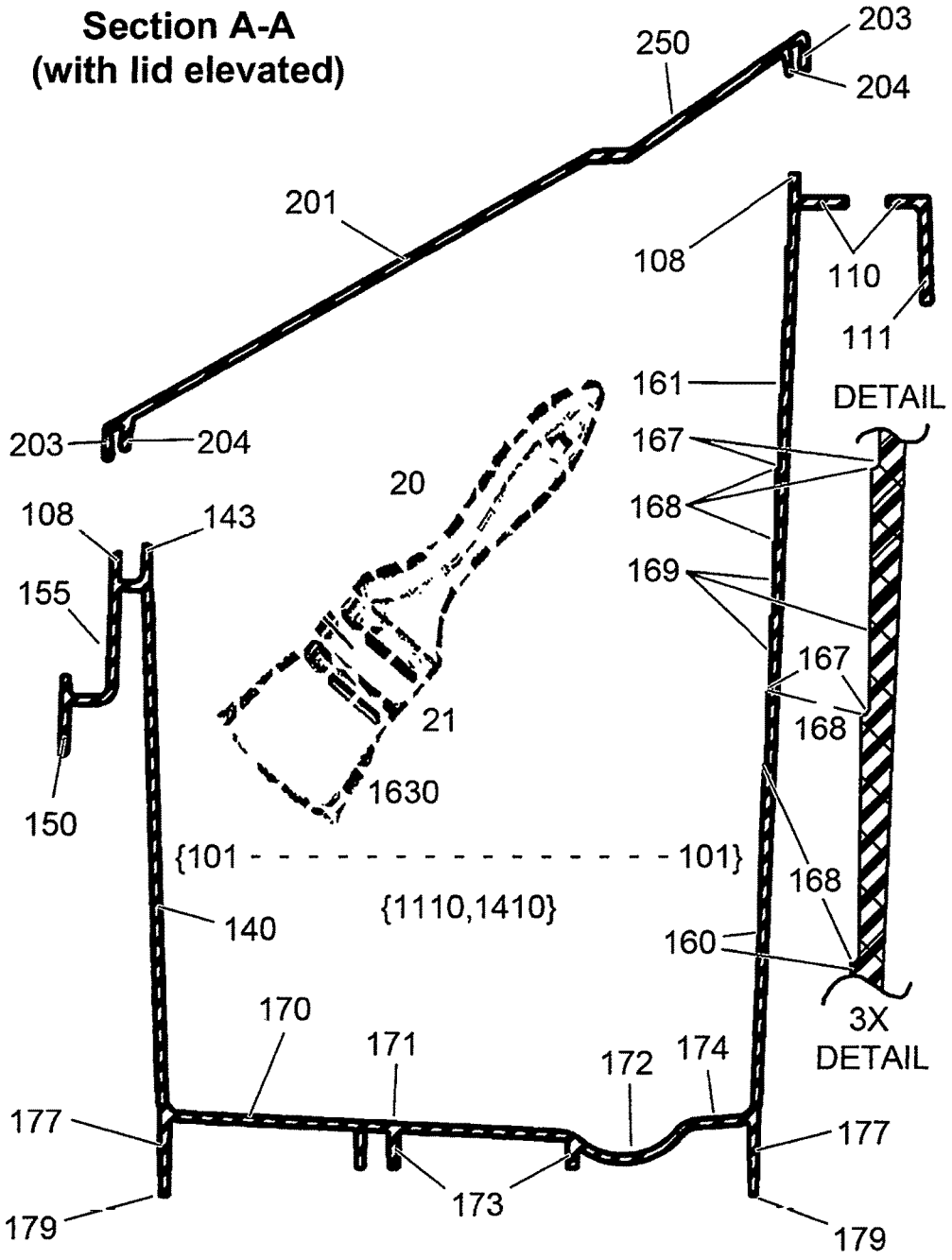
FIG. 16. A cross sectional view taken on a vertical plane A-A in FIG. 15, shown with the lid elevated.

With reference to FIGS. 1 and 16, the interior surface of the rear wall 161 can be provided with a textured surface 162. A detail view of the texture pattern is shown in FIG. 16. The texture can be in the form of a pattern of approximately horizontal ledges 168 that extend approximately 0.025 inch into the reservoir area, then have an approximately vertical downward section of about 0.8 inch 169, then another approximately horizontal ledge 168. A radiused fillet 167 of approximately 0.025 inch radius can be provided in the concave corner where a ledge 168 meets a face 169. This radius can make the textured pattern easier to clean while maintaining traction on the roller. The net horizontal offset per ledge including the fillet can be approximately 0.025 inches.

When seen from the front, the ledges 168 can form a series of laterally symmetrical curves that have outer sections that form an upwardly convex curve of approximately 2.5 inch radius, said curves meeting along the invention centerline in a slightly rounded vertex 165, with an upwardly concave radius of about ½ inch. This pattern of ledges can provide extra traction for the roller as it is rolled on the container's substantially planar rear wall. This pattern is provided as a backup measure. For optimal performance, a separate paint spreading screen or grid 70 is provided by the invention.

The paint-spreading screen 70 of the present invention provides a combination of improvements over the prior art. In a preferred embodiment the paint-spreading screen 70 is a substantially planar assembly without any hooks on its top side 71. Hooks on the top edge are the norm in the prior art. Hooks are a versatile means of securing a screen in a variety of buckets, but the hooks tend to interfere with installing a sealing lid 200 on the container 100. The lid 200 can be useful for temporary storage of paint and painting equipment 60, 20, 30.

Figure 17:
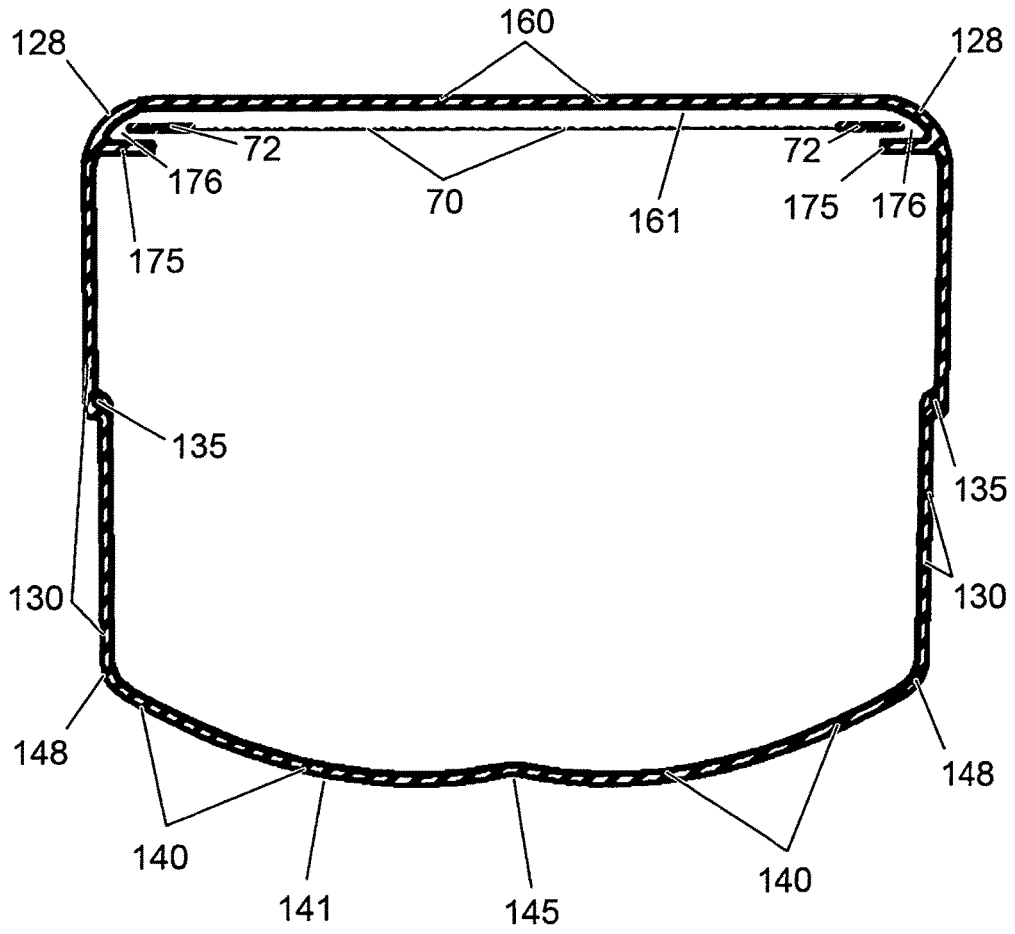
FIG. 17. A cross sectional view taken on a horizontal plane B-B in FIG. 15, shown with the paint spreading screen in place.

In a preferred embodiment of the present invention the paint spreading screen (or grid) is engaged to fit securely in place within the container 100 by means of two slots 176 (FIG. 17) formed into both side walls 130 of the container in their respective lower portions. The slots 176 can be formed by the combination of inwardly protruding webs 175 on the side walls and the interior surface of the rear-side corner wall 128. The slots 176 can engage the side beams 72 in their lower portion 73 and the spreading screen assembly 70 is positioned in place as shown in the cross sectional view of FIG. 17; the position being nearly parallel to and slightly offset from the rear wall 160 of the container 100. Depending on the qualities of the liquid being rolled and the roller nap, an appropriate offset could be ⅛ inch at the bottom 75 and somewhat less at the top 71 of the screen 70.

To position the screen 70 in an effective and secure position it can be desirable to provide the lower portions on the screen side beams 73 with a slight curvature 74, which is concave to the side facing rearwards. This curvature 74 can easily be adjusted by hand bending of metal side beams 72. The top 71 and bottom 75 edges of the screen benefit from deburring, but do not generally require supporting beams.

A pivoting bail type handle assembly 400 with special stop elements 117 (FIG. 3) can be provided by the present invention. The handle can be configured to pivot from a hole 122 in the container 100 vertical side flange 133, along a pivot axis 415. The handle can have a suitable bail 405 length such that the handle grip 410 will swing clear of the lower end of the cloth-holding flange 152 when swung forwards and down for stowage. At the other extreme of its swing travel the bail portion 405 of the handle assembly 400 can be configured to engage stop elements 117 on the container's outward side flanges 132.

By engaging the stops 117, the grip element 410 of the handle assembly 400 is positioned in a location approximately three inches above the corner defined by intersection of the horizontal rear flange 110 and the vertical rear flange 111. In this position, the combination of the handle grip 410, the bail 405 and the two rear flanges 110, 111 can form an ergonomic hand hold for gripping the invention, as depicted in FIG. 1.

Figure 7:
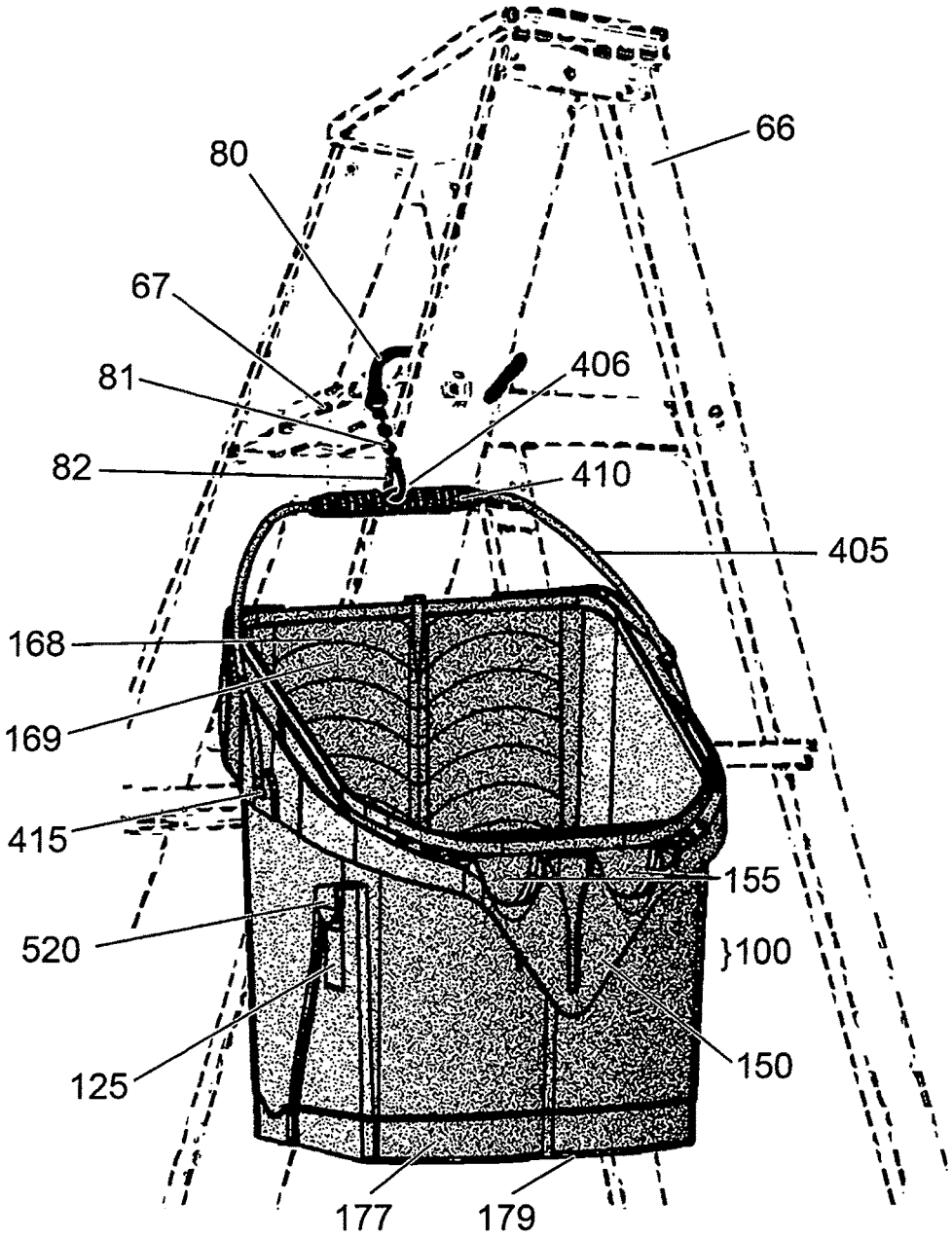
FIG. 7. Perspective view showing the container element of the present invention suspended with a hook from a ladder rung.
Figure 8:
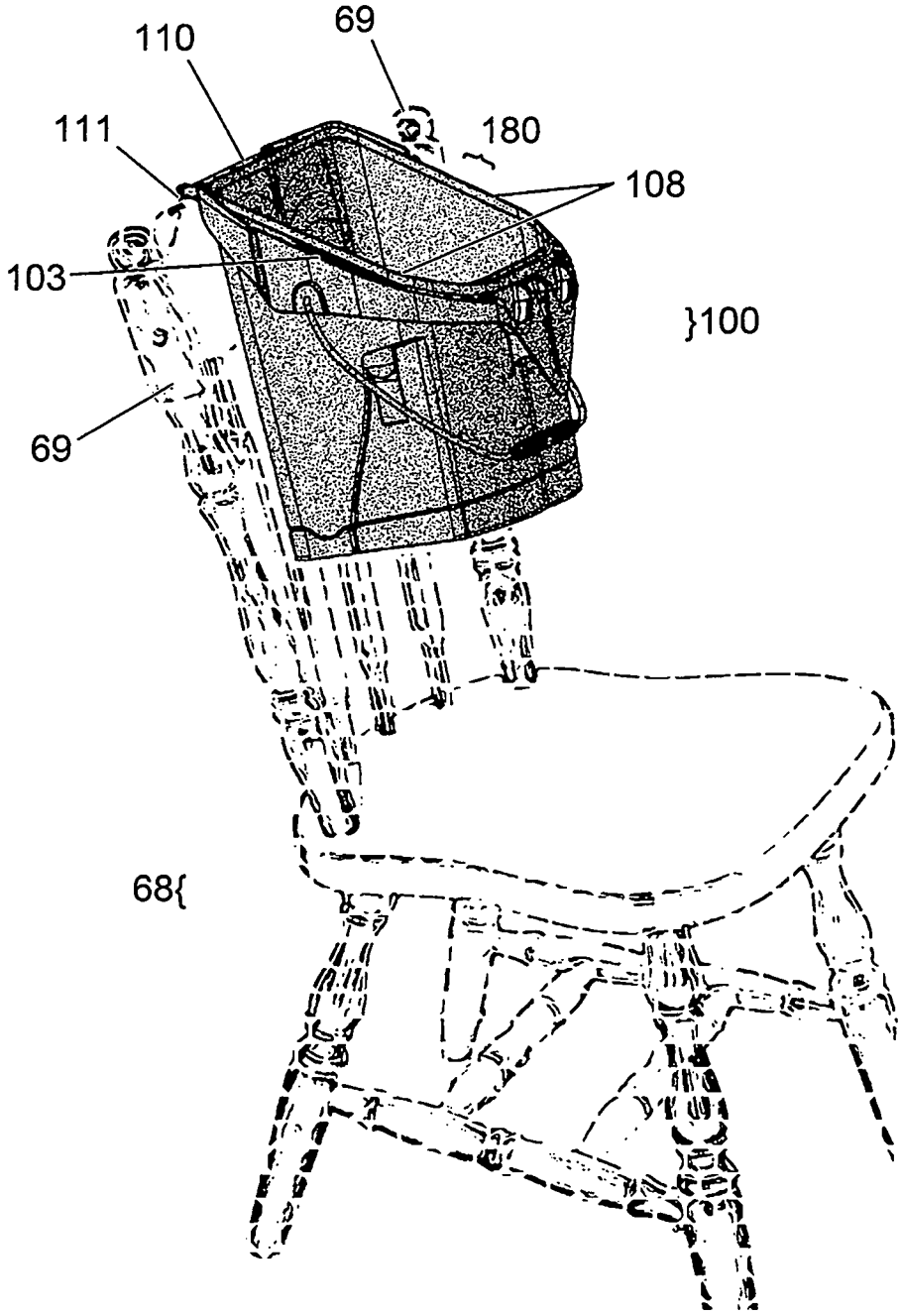
FIG. 8. Perspective view showing the container element of the present invention suspended on a chair back.

With reference to FIGS. 3 and 7, a preferred embodiment of the present invention can be provided with a pivoting handle assembly 400 formed partially of a rigid material such as wire 405, and with a resilient enlarged diameter gripping portion 410 in its central section. The central bend in the handle bail element 405 and a cutout 411 in the resilient grip element 410 form can an opening 406 configured to provide convenient means of securely attaching a detachable connector 82 to the handle near its middle. The detachable connector 82 (FIG. 7) may be integrally joined to a flexible element 81 and to a ladder hook 80, which enables suspending the container 100 from a ladder rung 67 or other structural member. Alternately, the connector 82 may be joined to a hoisting element such as a cord or rope for securing or elevating the container.

A preferred embodiment of the present invention can be molded from a semi-flexible thermoplastic such as polypropylene and polyethylene. To reduce manufacturing costs and facilitate injection molding, it can be desirable to taper the walls 130, 140, & 160 inward as one moves downward from the open top 180. An inward taper of 2 degrees on each wall has been employed in several embodiments. On the inner face 161 of the rear wall 160 the faces 169 (FIG. 16, detail) of the pattern can be angled to avoid undercut pulls in the molding process. To assure this, the length of the ledge portion 168 of the pattern can be less than the tangent of the overall wall taper or draft angle times the height of the substantially vertical face 169 between ledges 168. Since the sine of 2 degrees is approximately 0.035, the ledges 168 would need to be less than 0.028 inches wide if separated by a face height 169 of 0.8 inch (0.035"×0.8">0.028").

As shown in FIG. 3, the bottom 170 of the container 100 reservoir area 101 can be divided into three areas: a front gently sloping plane 171; this plane drains rearward into a recessed cylindrical well 172, which can be sized to fit a paint roller element 65; and also a small rear flat area 174 which can drain forward into the roller well 172.

Figure 12:
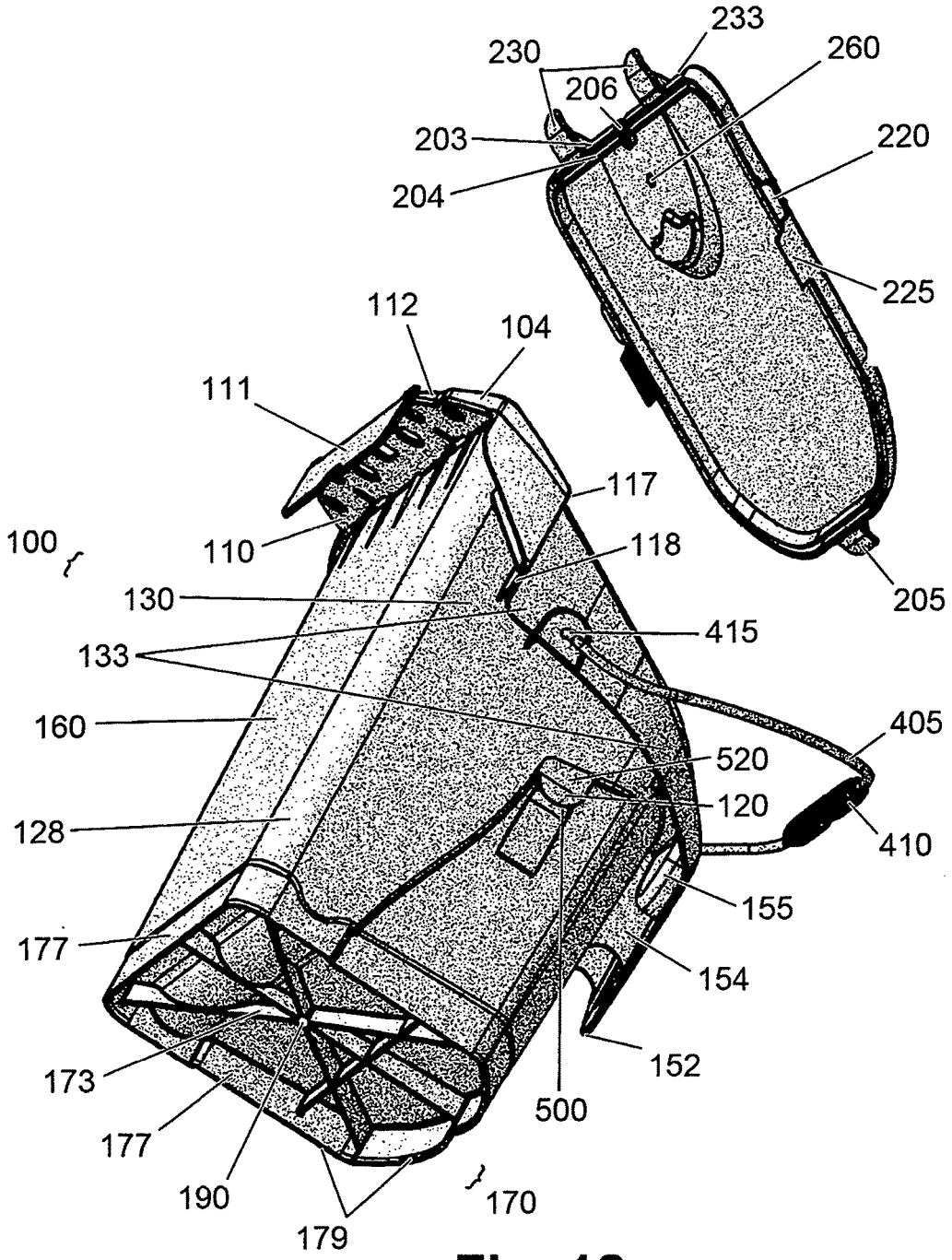
FIG. 12. A bottom perspective view of the container and lid, showing the lid elevated and the handle forward.
Figure 13:
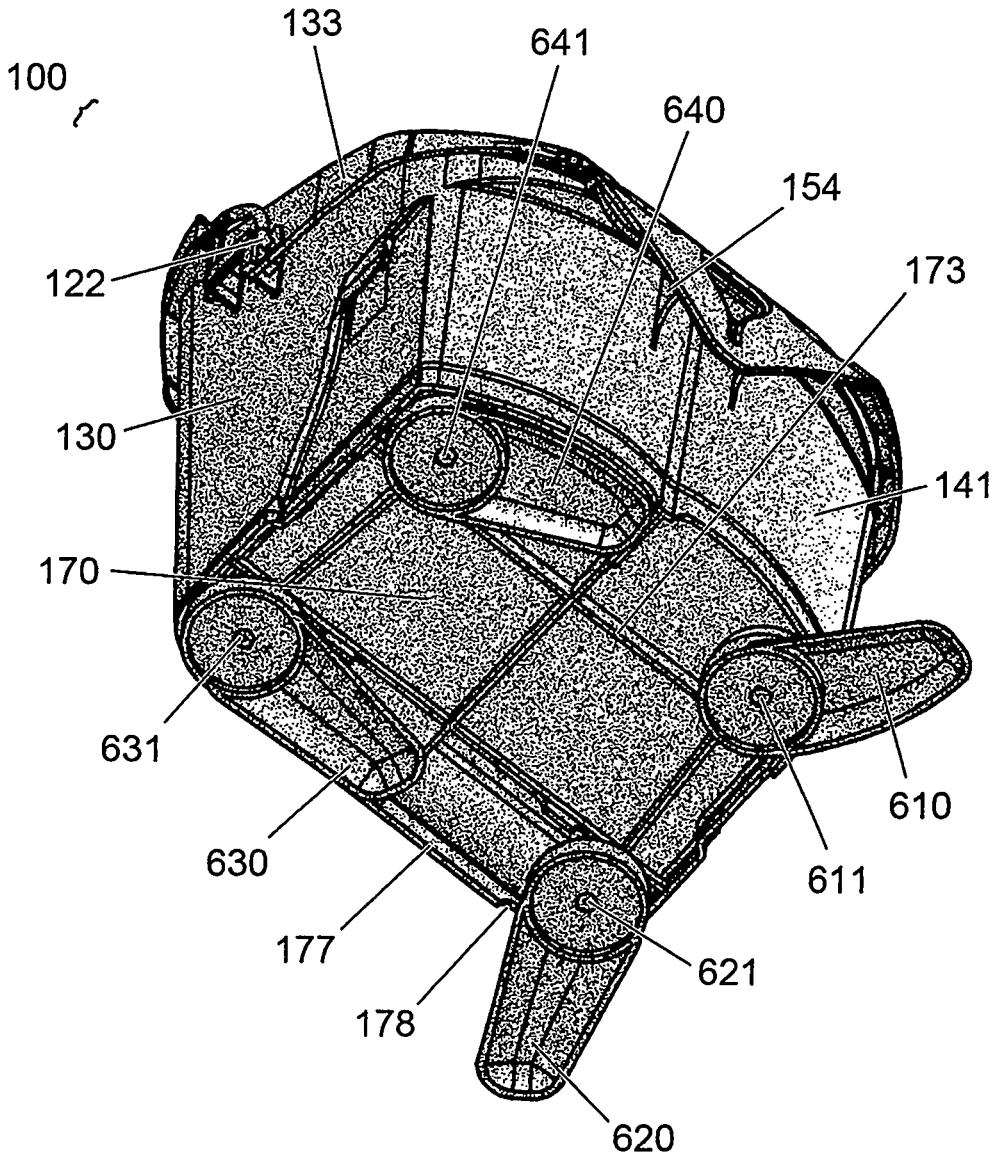
FIG. 13. A bottom perspective view, showing an embodiment of the container with pivoting legs in retracted and extended positions.
Figure 14:
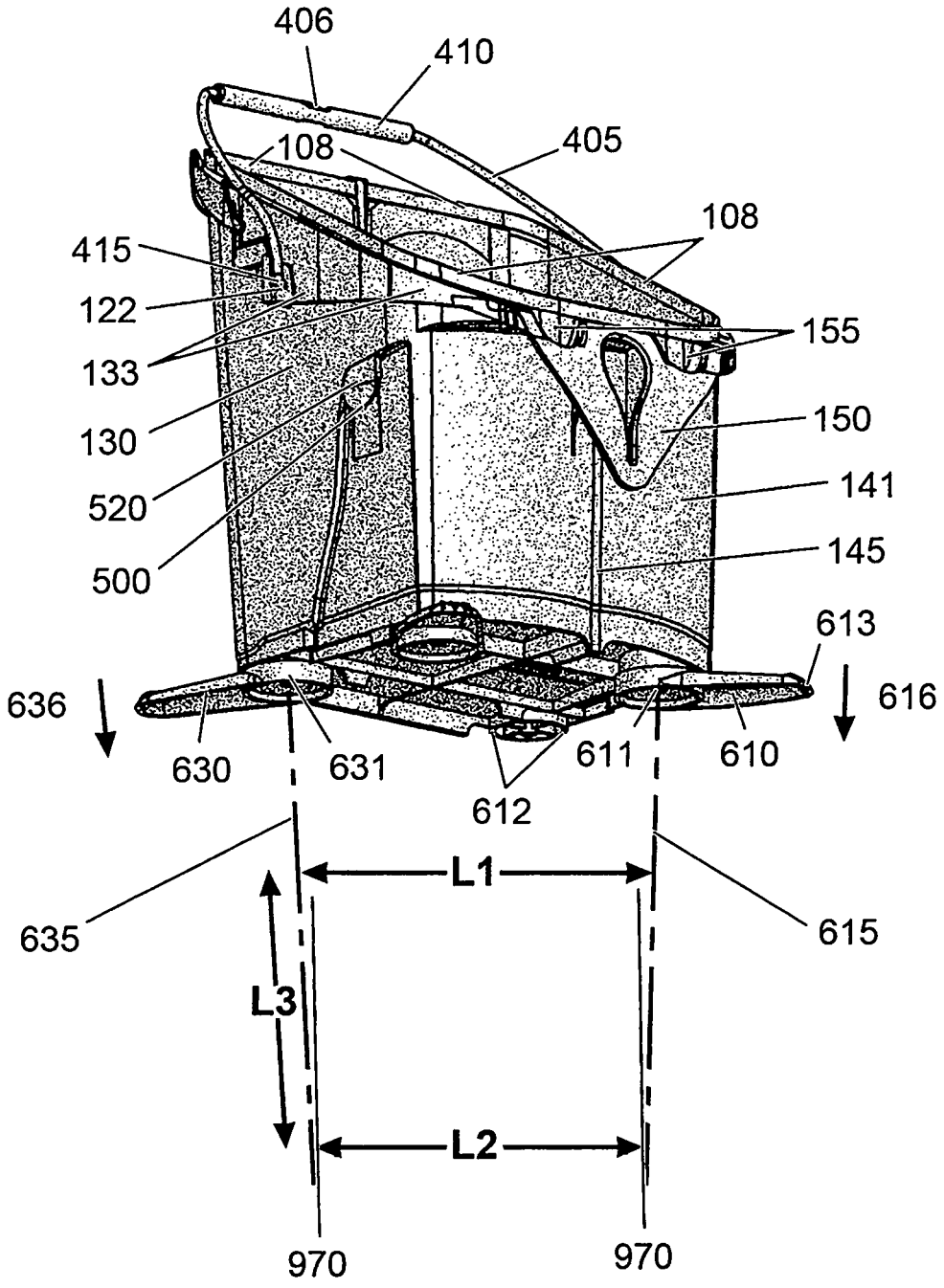
FIG. 14. A lower perspective view showing the preferred non-parallel axes of diagonal leg pivots.

The bottom 170 (FIG. 12) can be provided with various downwardly extended stiffening webs 173. The webs 173 can beneficially radiate outward from a central boss point 190 where plastic can be injected into the container mold. A downward tapering flange web 177 can extend down from around the periphery of the bottom 170. In an embodiment with legs, cutouts 178 can be provided in the bottom flange 177 for legs 610, 620, 630, 640 to protrude, as shown in FIGS. 13 and 14.

In a preferred embodiment depicted in FIGS. 1, 9, 11 and 17, the front wall of the container can be formed of two outwardly convex cylindrical surfaces 141 that meet in a near-vertical central indentation 145. The indentation 145 can provide for additional strength as well as clearance for using the cloth holder 151. The curvature of the surfaces 141 can help to provide a compact shape for the invention, allowing it to be placed within a five-gallon pail for transportation.

In a preferred embodiment one of the tool-holding areas 151 (FIG. 2) is configured to retain a cleaning cloth 90. The form of the cloth holder 151 can be a curved and approximately 'V' shaped hole in a downwardly turned portion 150 of the invention's tool-holding flange 103. In the lower part of the 'V' notch 153 the sides of the holder can beneficially become parallel or nearly so, to prevent the cloth 90 from working upward and falling out.

In a preferred embodiment, a portion of the tool-holding flange 103 can have receiving pockets 155 configured to hold a quantity of painter's putty, the putty holding areas can be formed by a pair of shallow recesses 155 located symmetrically on the front flange 150 of the container. For extra strength and rigidity, supporting webs 154 can be provided between the container front wall 140 and the front flange 150.

As shown in FIGS. 20 and 21 a magnet 500 can be enclosed within a magnet pocket 550 located in each side wall 130 of the container 100. Two tapered, downwardly pointing, free-hanging, extensions or ears 530 can be provided proximal to, or within, each magnet pocket 550 to hold the magnet 500 firmly in place after the magnet 500 has been inserted from below along the magnet insertion trough 125 and popped into place within the magnet pocket 550. The outer wall of the magnet pocket 550 can be formed by a thin plastic extension 120 of the container 100 body; extension 120 can have an outer face 520. The free-hanging nature of the ears allows them to flex as a magnet 500 is inserted and also flex as an injection molded plastic part ejects from the mold.

As shown in FIGS. 9, 10, 11 and 12, a lid assembly 200 for the container 100 can be provided in a preferred embodiment. The lid assembly 200 can be equipped with a notch 206 in the back edge 233 of lid element 201. Edge 233 can be configured to engage the rear side of the open top 180. The top of the rear wall 160 of the container can have a small downwardly extending notch 106 that aligns with the lid notch 206 when the lid 201 is closed in place. The lid 201 can additionally be provided with two tabs 230 on the back edge 233. In addition to providing lifting tabs for removing the lid, the tabs 230 can be configured to slip into slots 115 in the horizontal portion 110 of the container rear flange. The tabs 230 can have narrowed areas 231 proximal to where they join to the lid 201. The narrow areas 231 can snap into place when the snugly-fitting tabs 230 are fully inserted into the slots 115 in the rear flange 110. The lid assembly 200 is given the identifying number 202 when in its rear stowed position, as shown in FIG. 10. The lid assembly 200 can be configured to engage an angled open top 180 on the container 100; the angled open top 180 can be fitted with a vertical upwardly extending lip 108 around the periphery of the open top 180. The lid assembly 200 can engage the container lip 108 in a vertical direction 970.

The lid assembly 200 can comprise a substantially vertically downward extending pair of lips: an outer lip 203, and an inner lip 204; these lips can be configured to mate with the upwardly extending lip 108 on the container 100 thus forming a substantially vapor-tight seal between the container 100 and the lid 201.

The slot 207 between the inner lip 204 and outer lip 203 of the lid 201 may beneficially comprise a wider gap at the base of the slot 208 and have a narrower gap at the entrance to the slot 209; the gap width near the entrance 209 can beneficially provide a snug fit on the container flange 108.

The container flange 108 may have parallel and vertical wall sides formed with considerable precision, so as to fit well in the slot 207 of the lid element 201. For a snug fit, the gap at the entrance to the slot 209 can be slightly smaller than the thickness of the container flange 108; 0.002" to 0.005" of interference fit may be found sufficient to assure a snug seal. The gap at the base of the slot may beneficially be wider than the width of the container flange 108 plus twice the thickness of a removable liner 800. With this dimensional form the lid lips 203, 204 can flex and allow said container lip 108 with a liner 800 installed to be inserted all the way into the base 208 of the lid lip slot 207.

Because of this widening of the gap towards its base 208, the mold surfaces forming the slot 207 may experience an undercut or reverse draft situation. To allow the lid 201 element part to eject from the mold it can be beneficial to put compensatingly large amounts of positive draft on the face 210 of the inner lip opposite to the slot face. The outer face 211 of the outer lid lip 203 can be formed by a second section of mold that joins to the first section containing the lid slot 207 forming plug. As the two mold sections separate, the lid part 201 can stay with the lid slot plug until the outer face 211 of the outer lip has cleared its second mold section. Once clear of this second mold section the outer lip 203 can flex and come off of the lid slot forming plug incorporated in the first mold section.

The lid element 201 may beneficially be molded from a semi-flexible thermo-plastic such as polyethylene. The plastic used for the lid 201 may beneficially be softer or more flexible than the plastic used to mold the container element 100.

A typical wall thickness of approximately 0.090 inches can be used in preferred embodiments of both container and lid.

Figure 9:
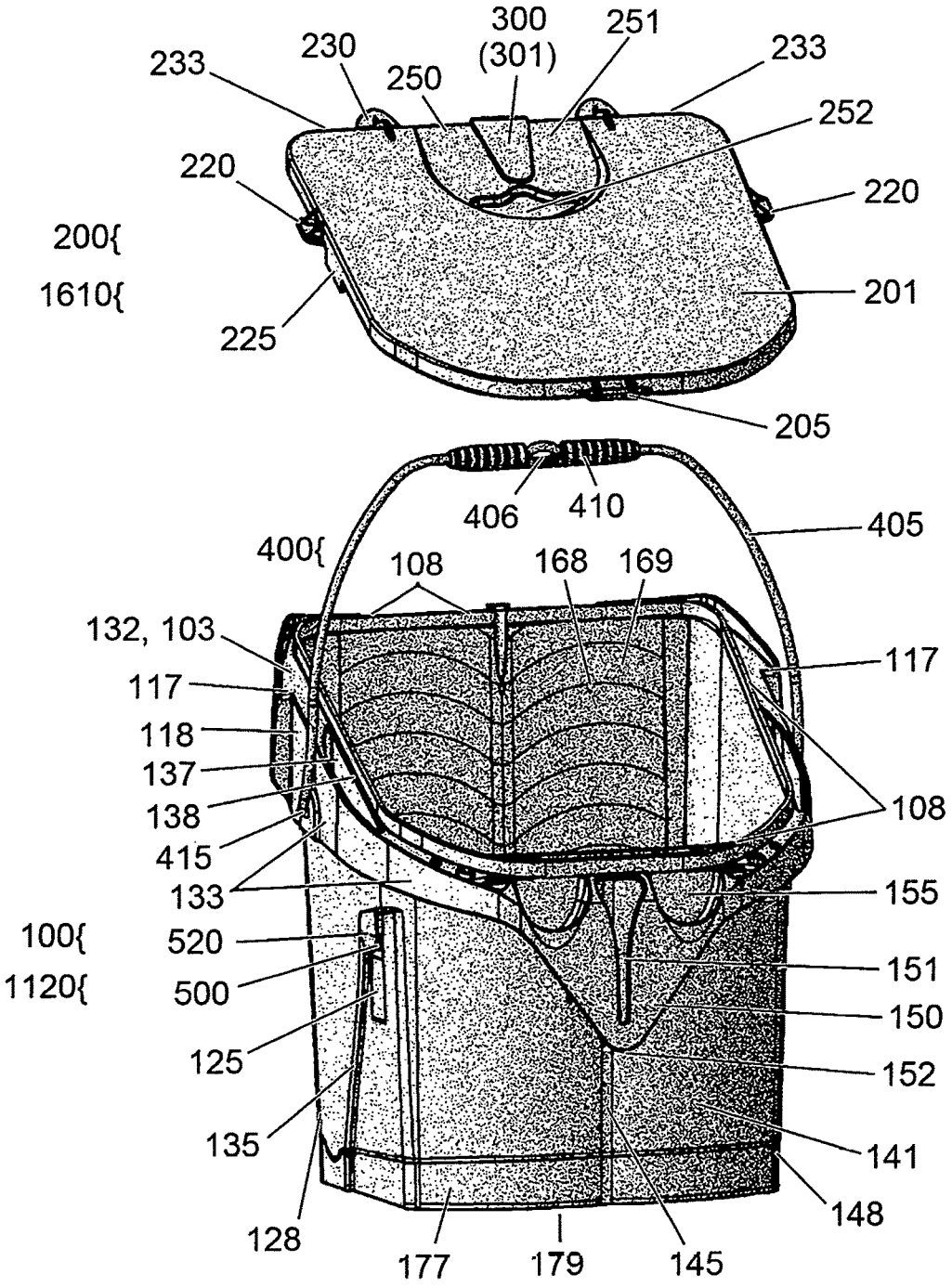
FIG. 9. Front perspective view showing a preferred embodiment of the present invention with elevated lid and vertical handle position; a notch-sealing flap in lid is shown in closed position.
Figure 10:
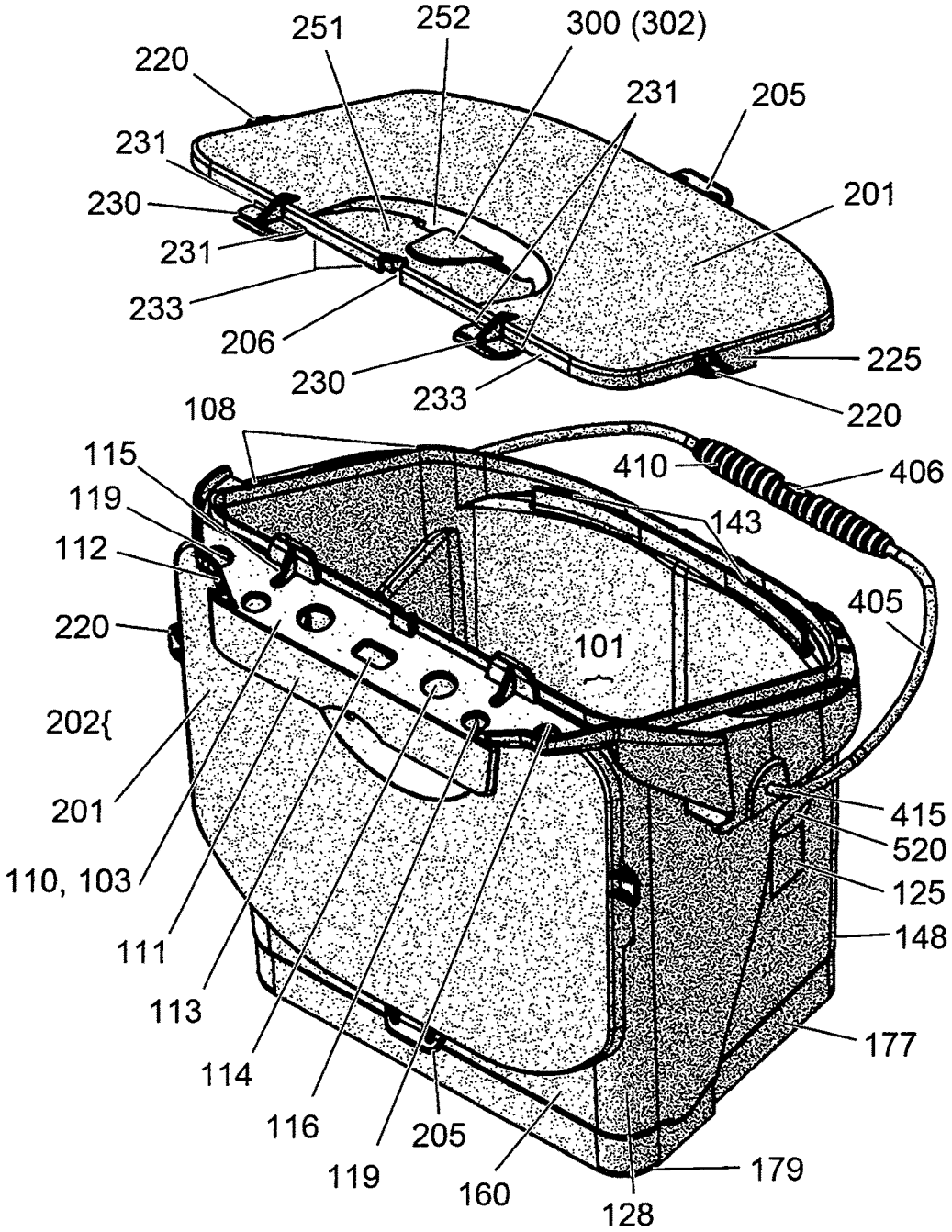
FIG. 10. Rear quarter perspective view showing the lid elevated and also alternately, the lid in a rearward stowed position, bail handle forwards; the notch-sealing flap attached to the lid shown in open position.
Figure 19:
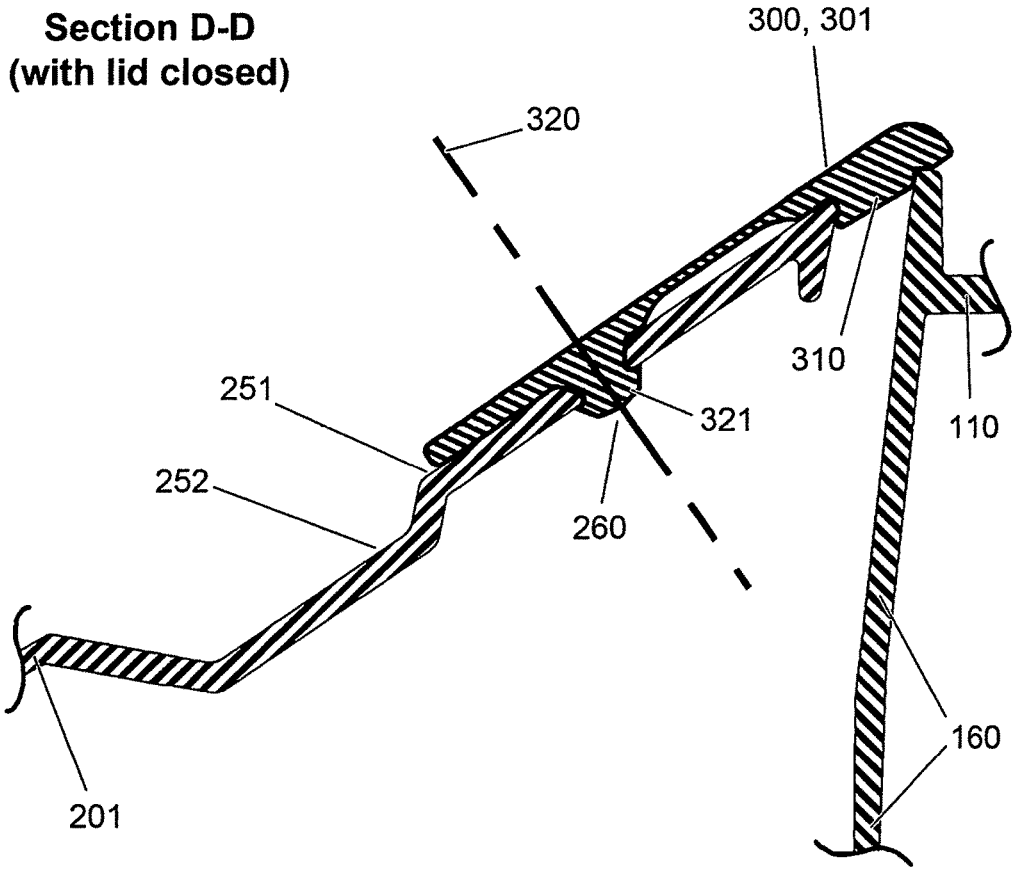
FIG. 19. A detail cross sectional view of the lid, flap and container taken on a vertical plane D-D in FIG. 15, shown with the lid closed and the lid flap closed, this view is taken on the vertical mid-plane defining the container's possible symmetry.

As shown in FIGS. 9, 10 and 11, the lid assembly 200 can be fitted with a moveable flap 300, said flap 300 being configured to movably cover a notch 206 in the lid when no roller tool shaft 62 is in place. This would maintain a substantially vapor-tight seal when the lid is closed without a roller tool 60 filling the hole formed by the container notch 106 and the lid notch 206. The flap 300 can beneficially be joined to the lid 201 by means of a pivot 321 with an axis 320 as shown by sectional view in FIG. 19. The flap element 300 can alternatively be molded as part of the lid 201 with a flexure attachment between flap 300 and lid 201.

When pivoted away from the notch 206 as seen in FIG. 10 the protruding portion of the flap 310, which is configured to fill the notch 206, can be provided with a recess 250 in the top of the lid. The recess can have a main semi-circular section 251 and a deeper inverted tee-shaped section 252. These recesses 251, 252 can provide clearance for the flap protrusion 310 to stow without flexing the material of the flap element 300. The flap element 300 can require some flexing when going from the closed position 301 to completely open position 302.

The lid 201, when closing, can utilize protruding tabs 225, which have ridges or extensions that can engage contours at 138 along the edge of the hole 137 in the tool flange 103 around the container body 100. This can provide a 'snap into place' function. These protruding tabs 225 can extend downward from the lid 201 when it is closed in the normal resting position of the container. The tabs 225 can engage an outwardly extending ridge 138 formed by the inner edge 138 of the elongated scraper-holding hole 137 in the container's side tool-holding flange 132, 103.

The lid 201 can be provided with a plurality of tabs extending outward from the edges of the lid. Two of the tabs 230 can be configured to insert into and be held securely in correspondingly shaped holes 115 in a horizontal flange 110 extending rearwards from the main container 100 body. The tabs 230 and slots 115 can beneficially be configured to assure that the lid will lie closely along side of the rear planar wall 160 on the exterior of the container 100 when the lid assembly 200 is in a rearward stowed position 202 as shown in FIG. 10.

Figure 4:
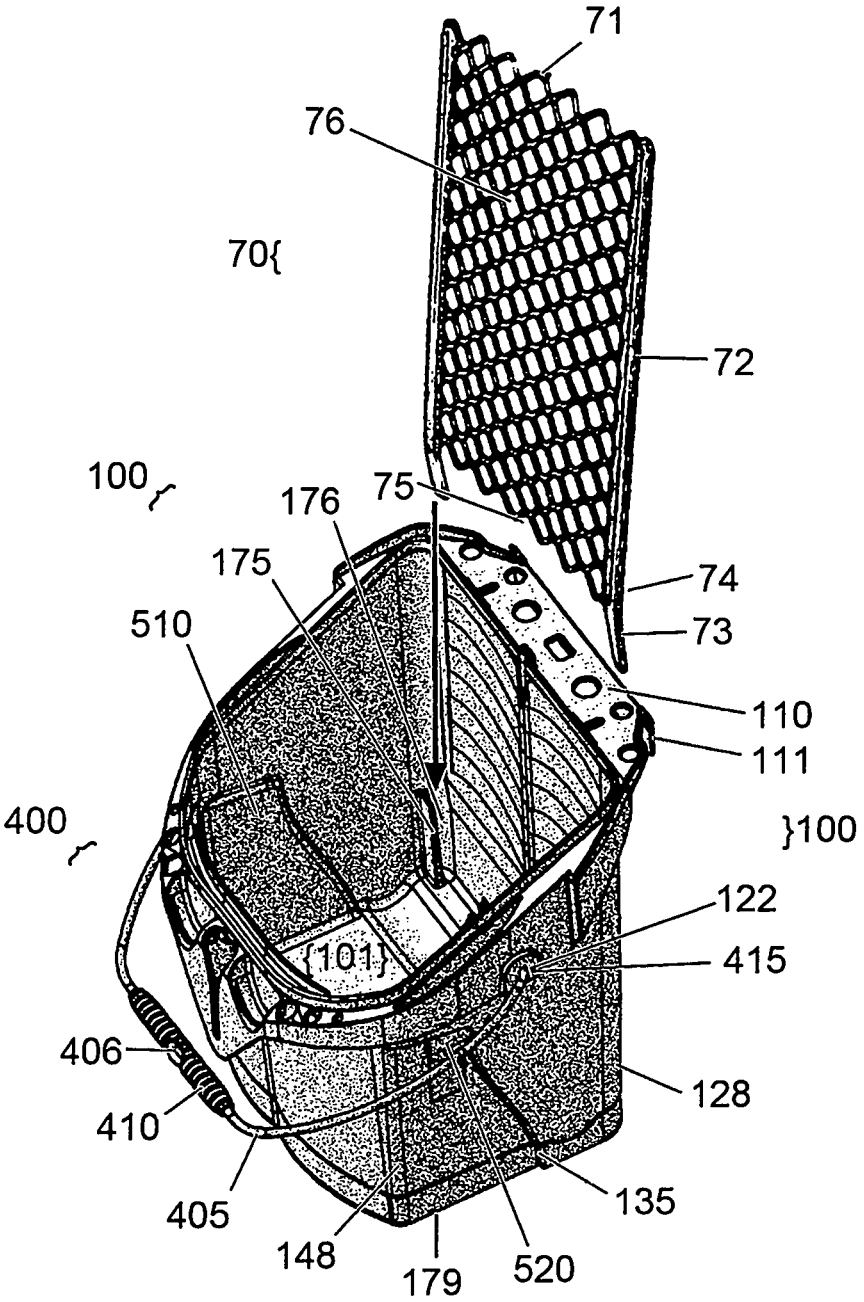
FIG. 4. Front prospective view shown depicting insertion of a paint-spreading screen.

In a preferred embodiment shown in FIG. 4, a paint-spreading grid or screen 70 inserts to fit within a container 100, where the grid 70 can be a substantially planar element, without suspension hooks. The grid 70 can be held securely within the container 100 in a position nearly proximal to a rear planar wall 160 by slots 176 comprised into the interior of the container 100. The spreader grid element 70 can beneficially have rigid beam elements 72 on either side of a porous central element 76

The beams 72 can be configured to engage the slots 176 in the interior of the container. Slots 176 may beneficially be formed by the following combination: on one edge of the slot by flanges or webs 175 that extend approximately ½ inch inwards from the interior faces of the side walls 130 of the container 100; and on the other edge of the slot 176 by the interior surface of radiused corners 128 of the container 100.

The flanges or webs 175 can beneficially additionally perform the function of preventing jamming or locking together when multiple containers 100 are stacked for storage (without grids 70 in place). To effectively achieve this stack-defining function the flanges 175 can terminate in a substantially horizontal top edge 185 located some distance above the bottom of the container, per preferred example: if the lowest extent 179 of the bottom perimeter flange 177 is located 3.4 inches below the top edge 185 of the web 175, the stacking interval will be 3.4 inches. When stacked, the web flange 175 of a lower container will engage the bottom edge 179 of a container stacked above.

In the preferred embodiment of FIG. 4, it can be beneficial to provide a slight curvature 74 to the side beams 72 of the grid, with the concave side proximal to the nearby rear wall 160. This feature can help to position the grid more securely and place the top edge 71 of the grid element closer to the nearby rear wall 160. To allow for drainage of paint through the grid, it is beneficial to provide for some gap between the grid and the nearby rear wall 160, approximately 1/16 to 3/16 inch being found sufficient in a preferred embodiment.

In a preferred embodiment shown in FIGS. 20 & 21, magnets 500 are contained within the side walls 130 of the container 100. The magnets 500 are close to the surface of the container on both the inside 510 and the outside 520 and can therefore be capable of independently holding magnetically attractable tools 20, 30 both on the inside 510 and on the outside 520 of the container 100, near a magnet 500.

In a position approximately above a magnet 500 an additional supporting element can be provided in the form of an oblong hole 137 in the side flange 132 running along the side of the open top 180 of the container. The perimeter of this hole 137 can provide additional support for a tool 30 attracted to and held by the magnet 500 to the proximal exterior face 520.

In a preferred embodiment, the magnet-equipped side walls 130 of the container can be formed by two substantially parallel elements that are offset laterally 135 from one another by a distance of approximately 0.15 inch. This offset distance can correspond to the approximate thickness of the magnets 500 contained within the walls 130 of the container 100. The offset 135 may provide for easier molding of magnet-holding pockets 550 within a plastic container part. The offset 135 can also contribute structural integrity to the side walls 130.

The magnet pockets 550 can comprise means of securely holding the magnets in position. The form of the magnet holding means can comprise molded plastic pockets 550 within the side walls 130; the pockets 550 being substantially open on the bottom side. The pockets can be additionally equipped each with two downwardly extending, tapered, semi-flexible plastic 'ears' or extensions 530 that will hold a magnet 500 firmly in place after the magnet 500 is snapped Into position from below. The taper of the ears 530 helps to ensure that the ears 530 can separate from the mold section that forms them, by means of bending and flexing of the ears 530.

The magnet 500 can be positioned within the side walls 130 such that a relatively thin layer of non-magnetic plastic covers the magnet on both sides 510 and 520. The thickness of the covering layer may taper and can be in the range of approximately 0.015 inch to 0.030 inch. This is in order to provide sufficient structural integrity while providing for a sufficiently short distance between the magnet 500 and a magnetically attracted tool 20, 30. A short distance can assure an adequate holding force between a tool 20, 30 and a magnet 500.

To effectively hold tools, the magnets 500 can be embedded within the side walls 130 of the container 100 in a location approximately one third of the way from the front top lip 108 of the container 100 to the bottom 170, and approximately one quarter of the way from the front wall 140 to the rear wall 160.

In a preferred embodiment bi-functional magnets 500 can be utilized to simultaneously hold a paint brush 20 as well as a scraping tool 30 with the same magnet 500. In the exemplary preferred embodiment, a magnet 500 is inserted into a close-tolerance receiving structure 550 located in the side wall 130 of the container.

The offset 135 in the side wall 130 can allow the magnet 500 to have close proximity to both a paintbrush 20 on the inside 510 of the container and a scraper tool 30 on the outside 520. The offset 135 can make for easier injection molding of the magnet pockets in the container 100. For example: in this preferred embodiment an approximately 0.025" interior plastic wall between the side of the magnet and the metal band 21 around a paintbrush 20 allows a 0.75 inch diameter magnet 500 to firmly hold a brush 20. On the outside 520 of the magnet enclosure, an approximately 0.025" thick plastic skirt 120 helps to hold and enclose the magnet, defining the magnetic flux gap spacing for gripping of a scraper tool blade 31.

Figure 6:
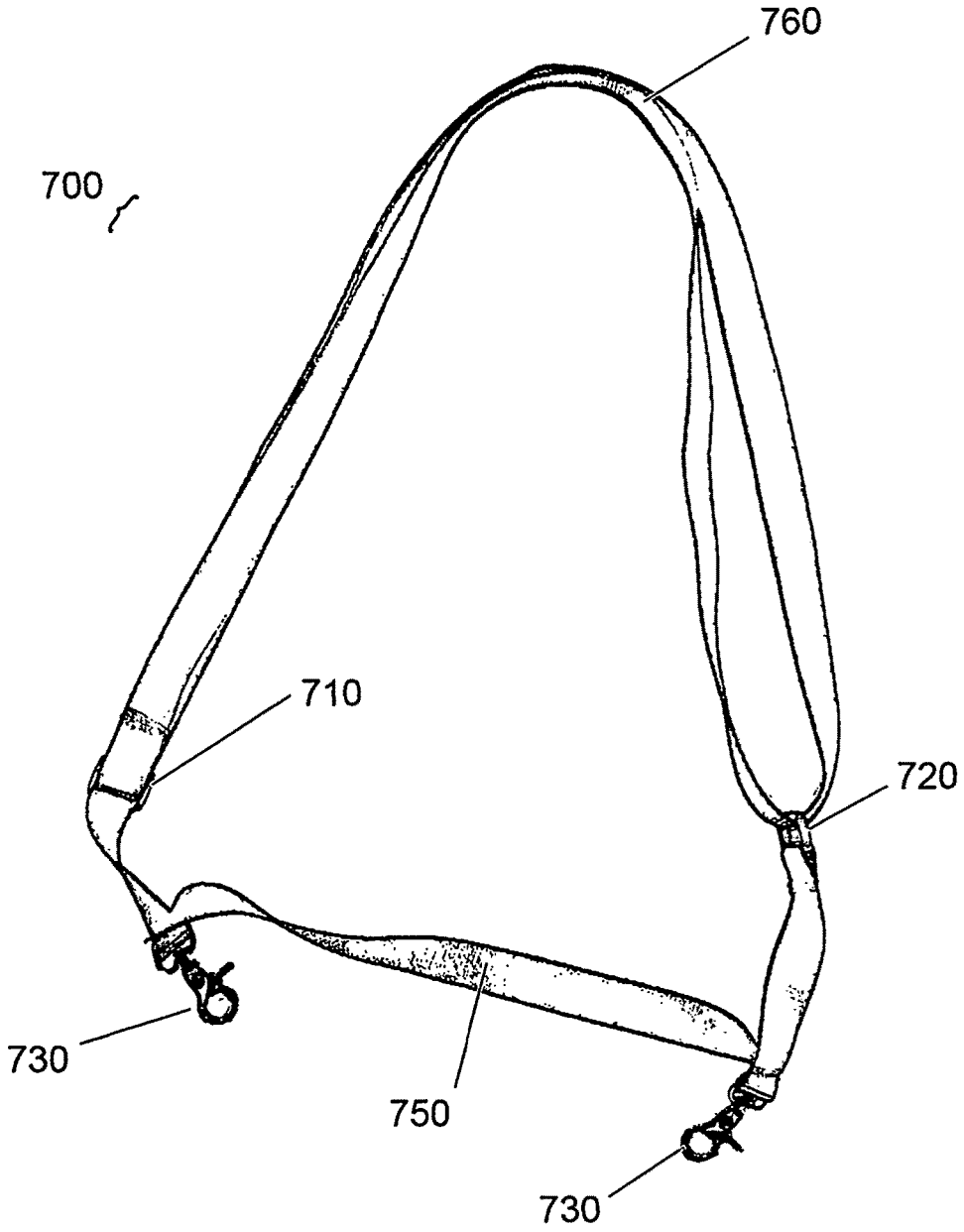
FIG. 6. Preferred embodiment of the carrying strap loop.

As shown in FIGS. 5 and 6, a carrying strap 700 can be provided by the present invention. The carrying strap 700 can be formed as a complete loop, said loop form assuring that a user 50 of the invention may securely wear the strap separately, without a container 100 attached, and not have the danger of the strap 760 slipping off the shoulders because of loose ends. The loop form of the strap can enable a user to easily attach and detach the container from the strap element 700 by hooking the strap loop's lower portion 750 under a suitably shaped extension of the container 100 formed by a outward flange 110 joined to a downward flange 111, both flanges being near the top of the substantially planar rear wall 160 of the container 100. Additionally the substantially horizontal portion 110 of the rear flange can be provided with indentations 112 in its outer edge 104 near the corner where it meets the downward portion 111 of the flange. These indentations 112 can help to prevent the lower strap section 750 from slipping off the vertical flange 111, yet allow easy removal of the container 100 from the strap 700 when required. It can be beneficial to provide the strap loop with means of length adjustment 710, 720.

An outward extension 121 of the rear flange 111 can be provided. This extension 121 can form an enclosed area 112 which is capable of holding a strap 700 in place near a rear corner of the container 100. A narrow portion 124 of the area 112 can be narrow enough to grip a strap 700 as it is inserted into or removed from the enclosed area 112. The extension 121 can have a semi-flexible nature allowing it to flex as a strap 700 is inserted through the narrow gap 124. A hole 123 can be provided in the extension 121. By joining a hole 123 with a hole 119 with a length of cord or wire, the narrow portion 124 is effectively closed, preventing the strap 700 from being able to come out of the enclosed area 112.

The carrying strap 700 can comprise a pair of clips 730 or snap hooks, which can be attached to the lower portion of the strap 750 in positions that enable the clips 730 (or snap hooks) to be detachably fastened to appropriate points on the container body, such as a pair of holes 119 in the rear horizontal flange 110.

As shown in FIGS. 13 and 14, a preferred embodiment can be provided with a set of retractable legs. Four legs 610, 620, 630 and 640 can be provided, each one pivoting about a point 611, 621, 631 and 641 located near each Of the four corners of an approximately rectangular or trapezoidal bottom 170 on the container 100. The pivot axes 615, 625, 635 and 645 of the respective legs 610, 620, 630 and 640 can beneficially be angled in a manner providing additional stability. By making the pivot axes of the various legs converge together as the axes are extended downward additional stability may be achieved due to this non-parallel angling of the pivot axes. The ends of the legs like 613 that are distal from the container body will be lower when extended, relative to their vertical position when retracted, as shown in FIG. 14 by the arrows 616 and 636.

It is desirable to have the portions of the legs like 613 distal from their respective pivot axes flush or slightly above flush with the lowest portion 179 of the downwardly extending flange 177 that partially surrounds the bottom 170 of the container. When the legs are extended, it is desirable to have their distal portions like 613 below flush with the plane defined by the bottom 179 of the surrounding flange 177. The lower position of the distal ends 613 of the legs when extended helps to overcome any flex or slop in the leg pivots that might otherwise cause the container 100 to rock or wobble when resting on a flat horizontal surface.

The angling of the pivot axes may be achieved by angling the lower edge of a circular flange 612 that surrounds a pivot axis 611 on the container 100. The angle between the pivot axis and the vertical axis 970 of the container 100 can be called A1. The vertical axis of the container can be perpendicular to the plane defined by the bottom edge 179 of the container 100. As shown in FIG. 14, due to the angling of the axes the length L1 will be greater than the length L2. We have the formula:

$$L1-L2=L3*\mathrm{SINE}(2*A1)$$

which shows the convergence distance of two diagonally opposed axes 615, 635. The convergence of the axes causes a lowering of the leg ends 613 when extended. The lowering is shown by the arrows at 616 and 636 in FIG. 14.

Figure 18:
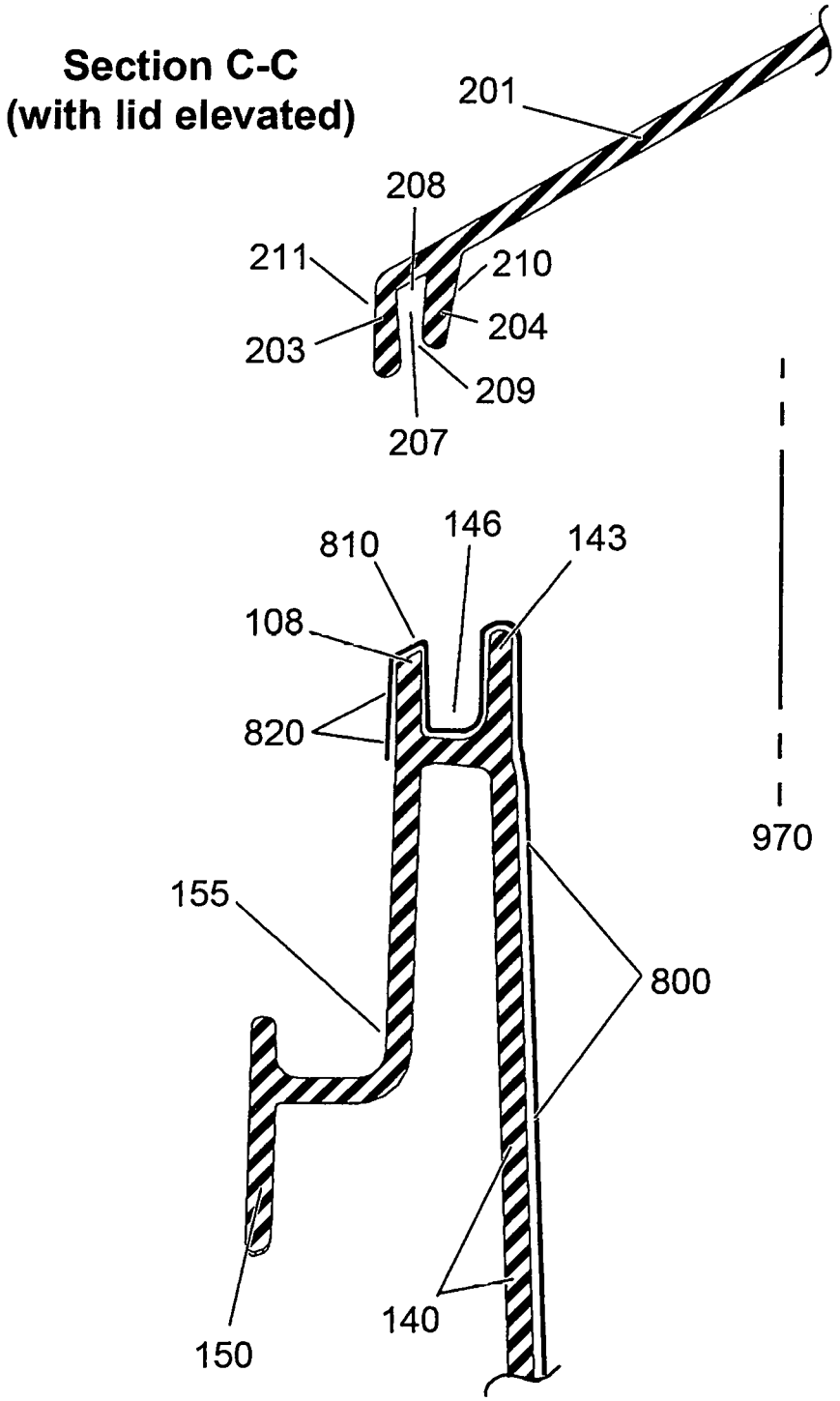
FIG. 18. A detail cross sectional view of the container, liner and lid, taken on a vertical plane C-C in FIG. 15, shown with the lid elevated, liner in place; the figure shows a cross section of the liner going over and around the brush grooming lip; this section is taken on the same plane as FIG. 16.
Figure 22A:
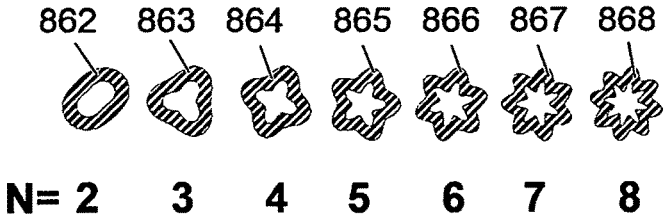
FIG. 22*a*. A series of cross sectional views of elastic collar stops with different numbers of periods of waviness 'N'.
Figure 22B:
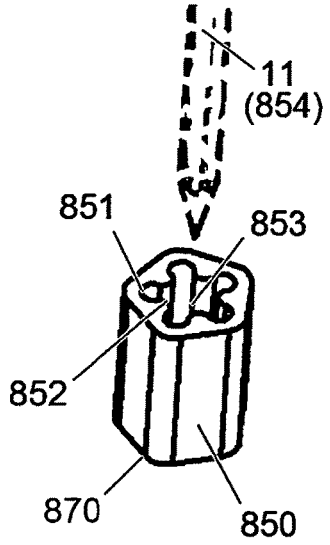
FIG. 22*b*. A perspective view of a pencil prior to insertion in an elastic tool stop collar (N=5).

In a preferred embodiment, a removable liner 800 for the container 100 can be provided. The liner 800 can be formed to fit closely within the container 100, including fitting closely within any interior slots 176 designed to receive a paint spreading grid 70. This helps to assure that the grid 70 will still fit in place with a liner 800 installed. FIG. 18 shows the front upper portion of a liner 800 in cross section as the liner fits closely over the container 100 front lips 108 and 143. The liner 800 can comprise an upper portion that is configured to fit closely over a top lip of the container in such a manner that the liner extends over the top of the lip 810 and then downward by area 820 over the outside surface of the lip 108, thus allowing the downward extending lips of a sealing lid 203 and 204 to effectively engage the container top lip 108 with or without a liner 800 in place. A preferred embodiment of the present invention can provide a resilient stop unit 850 for a substantially cylindrical tool such as a pencil 11, pen or the like, as shown in FIGS. 22*a* and 22*b*. The stop unit 850 can be formed from a somewhat elastic material and can have a flexible hole 853 sized to fit snugly around the cylindrical portion of a tool 854 and an outer extent 870 somewhat larger than the size of the flexible tool hole 853.

The tool stop unit 850 can prevent a tool 854 from passing completely through a storage receptacle consisting of a through-hole, like 114, 116, or 144, in a substantially planar support element as may be found on the tool-holding flange 103 of the present container invention.

The stop collar can have a wavy form with the shape defined in polar coordinates, by the equation as a function of polar angle P1:

$$R1=B1+C1*\mathrm{SINE}(N*P1)=\text{interior edge shape}$$

$$R2=B2+C2*\mathrm{SINE}(N*P1)=\text{outline edge shape}$$

The integer N can be varied to provide a varying number of lobes as shown in FIG. 22*a*. When N=2, the resulting shape 862 can have an oval cross section. When N=3, the section 863 can be triangular. When N=8, the shape 868 is an eight-pointed star, and so on. The waviness can provide for superior grip on a tool body as compared to a simple round hole.

A preferred embodiment of the present invention can provide a tape roll holder 900. The tape roll holder 900 can be configured to hold a roll of tape 40, such as masking tape, or a plurality of such tape rolls. The tape roll holder can comprise: a lineal flexible element 910 with a first and a second end (such as a length of nylon cord); a magnetically attractable element 920 (such as a ferrous fob) attached to the first end 911 of said flexible element; means of attaching the second end 912 of said flexible element to the container 100, such as a loop; and a magnet attached to the container 500.

The magnet can be capable of holding the fob 920, and the magnet can be located at a distance from the second end attachment point 903 that is less than the length of the flexible element 910.

To use the tape holder 900, the fob 912 end of the flexible element 910 can be passed though the central hole 41 of a tape roll 40, and then the fob 920 can be attached to the magnet 500. To remove the tape, the fob 920 can be manually detached from the magnet 500 and the tape roll 40 removed from the container 100 assembly.

Figure 24:
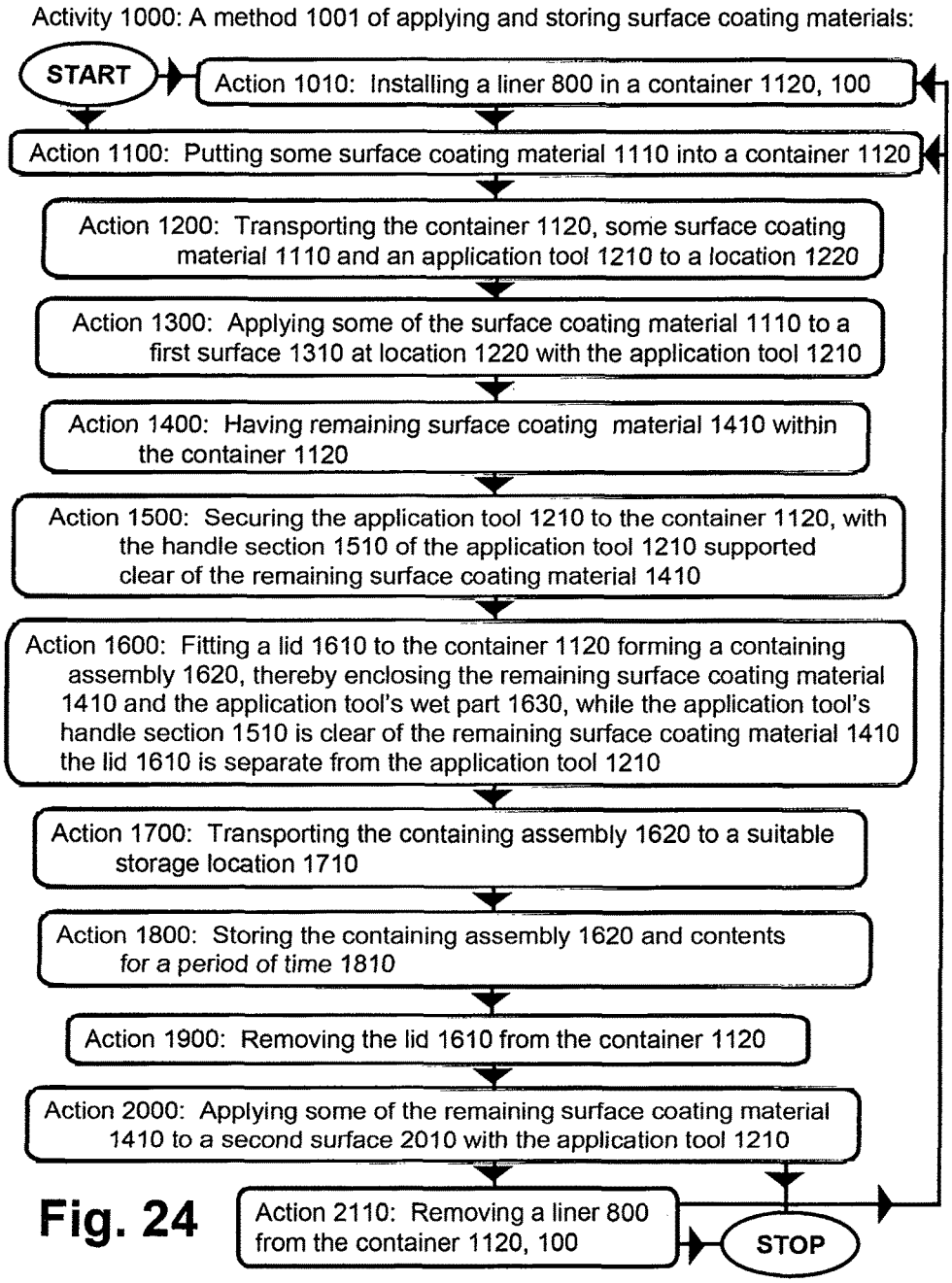
FIG. 24. A flow chart showing the method of the present invention for applying and storing surface coating materials

Description of the Method of the Present Invention:

FIG. 24 shows a flow chart depicting a method 1001 for applying and storing surface coating materials, whereby a quantity of surface coating material 1110 may be sequentially applied to various surfaces 1310, 2010 over a period of time 1810 without having to remove the coating material 1110 from the container 1120 or having to wash the application tools 1210, thereby saving time and materials, utilizing this method 1001 the handle portions 1510 of application tools 1210 remain clean of coating material 1110 during transport 1700 and storage 1800.

Action 1010 comprises the option of installing a liner 800 in a container 1120.

Action 1100 comprises putting a quantity of surface coating material 1110 into a container 1120. A liner 800 can be installed 1010 in said container prior to putting the surface coating material into the container, the liner being of a predetermined thickness, and the liner being configured to allow substantially normal operation of the lid and permitting formation of a containing assembly 1620 with a liner 800 installed, whereby the liner 800 may be optionally used and removed to facilitate color change or cleanout. The liner 800 can be constructed of thin flexible plastic material of a predetermined thickness of approximately 0.002" to 0.010", whereby the liner 800 is sufficiently thick to resist puncture in normal use, yet sufficiently thin to fit between the container 1120 and the lid 1610 when the containing assembly 1620 is formed, this allows optional use of a liner 800 with the lid 1610 and the container 1120.

Action 1200 comprises transporting the container 1120, a quantity of surface coating material 20, 1110 and an application tool 1210 to a location 1220. The application tool may be selected from the group consisting of: paint roller tools 60, and paintbrushes 20, and sponge tools, and faux finish rag tools, and spatulas 30, and spreading tools. Additionally a plurality of tools can be transported by tool-holding means on the container 1120. The container 1120 can be transported to the location 1220 by means of a detachable strap assembly 700, whereby a person 50 may transport materials and equipment with hands free.

Action 1300 comprises applying some of the surface coating material 1110 to a first surface 1310 at location 1220 with the application tool 1210. The container can be utilized at location 1220 while the container 1120 is attached to a person 50 by means of a detachable strap assembly 700, whereby the person may have hands free to use application tools or for other purposes. The container 1120 can be temporarily attached to a supporting element such as: a ladder 66, scaffolding, a door, a fence, a knob, a hook, a lanyard; thereby positioning and stabilizing the container 1120, 100 in a convenient position for use.

Action 1400 comprises having remaining surface coating material 1410 within the container 1120

Action 1500 comprises securing the application tool 1210 to the container 1120, with the handle section 1510 of the application tool 1210 supported clear of the remaining surface coating material 1410. Securing the application tool 1210 to the container 1120 can be done by magnetic means.

Action 1600 comprises fitting a lid 1610 to the container 1120 forming a containing assembly 1620, thereby enclosing the remaining surface coating material 1410 and the application tool's wet part 1630, while the application tool's handle section is clear of the remaining surface coating material 1410.

The lid 1610 is separate from the application tool 1210. The lid 1610 can engage the container 1120 by moving downward in a substantially vertical direction, at least one downward lip on the lid 1610 making sliding contact with an upwardly protruding lip on the container 1120. More specifically, in the preferred embodiment: an inner lip 204 and an outer lip 203 on the lid 201, 1610 can engage either side of an upwardly protruding lip 108 on the container 100, 1120, the upwardly protruding lip 108 can have the form of a generic cylinder, the defining sweeping direction of the generic cylinder being substantially vertical, whereby the lid 200, 1610 slides off and on along the defining direction and a container part may be ejected from a zero draft section of a mold along the defining axis regardless of the angle formed by the top 180 of the container 100, 1120.

The application tool 1210 can be selected from a group consisting of: paint rolling tools 60 and tools having a substantially cylindrical shaft section; the application tool 1210 having a handle 1510, an intermediate shaft section of a first predetermined size and a wettable section 1630;

Action 1600 can further comprise: placing the application tool 1210 in a notch 206 of a second predetermined size provided in the lid 201, 1610, while fitting the lid 201, 1610; the first predetermined size and the second predetermined size allowing the intermediate shaft section to fit closely in the slot; and allowing the handle 1510 of the application tool to protrude from the containing assembly while the wettable section of the tool is enclosed within the containing assembly 1620; the first predetermined size and the second predetermined size resulting in a fit that provides a substantially vapor tight seal for the containing assembly 1620; whereby the wettable section 1630 of the application tool 1210 is prevented from drying out during storage 1800 and the tool handle 1510 is not in contact with the contained coating material 1410. The notch 206 can be provided with a moveable cover 300, whereby the containing assembly 1620 can be sealed against evaporation of contents more effectively when no tool shaft or handle is in the notch 206. The moveable cover 300 can be captive and pivot about a predetermined axis 320 on the containing assembly. Alternatively, the moveable cover 300 can be captive and attached to the containing assembly 1620 by a flexible element.

Action 1600 can additionally comprise temporarily attaching the lid 200, 1610 to the container exterior in a stowage location 202, the stowage location 202 being different from the position occupied by the lid 200, 1610 when forming the containing assembly 1620, whereby the lid 200 when so stowed 202, is immediately available to seal up the container and whereby the lid 200, 1610 is less likely to get lost. Additionally, adding a quantity of thinning liquid to the container 1120 prior to installing the lid 1610 can reduce drying out of the remaining portion of surface coating material 1410 during storage 1800, as an example, water can be used as a thinning liquid with latex paint.

Action 1700 comprises transporting the containing assembly 1620 to a suitable storage location 1710. Transporting the containing assembly to a suitable storage location can additionally comprise placing the containing assembly into the interior of a standard 5 gallon paint pail.

Action 1800 comprises storing the containing assembly 1620 and contents 1410, 1630 for a period of time 1810. If the surface coating material 1410 is latex paint, and the storage location 1710 is free of strong drafts and has room temperature conditions (averaging approximately 40 to 70 degrees Fahrenheit) the period of storage time 1810 between uses of the application tool 1210 can range from a few minutes to a period of approximately six months.

Action 1900 comprises removing the lid 1610 from the container 1120.

Action 2000 comprises applying some of the remaining surface coating material 1410 to a different surface 2010 with the application tool 1210.

In the foregoing discussion we make the preferred embodiments exemplary of the possible features and elements of the present invention. It will be clear to one skilled in the art that other embodiments employing the features disclosed herein will also fall within the scope of the present invention.

KEY TO IDENTIFYING NUMBERS USED IN THE FIGURES

Appendix Pages 1-10

11 PENCIL
20 PAINT BRUSH
21 STEEL BAND ON PAINT BRUSH
30 PUTTY KNIFE
31 STEEL BLADE OF PUTTY KNIFE
40 TAPE ROLL
41 CENTRAL HOLE OF TAPE ROLL
50 OPERATOR OF INVENTION
51 OPERATOR'S ARM
52 OPERATOR'S THUMB
53 OPERATOR'S HAND
60 PAINT ROLLING TOOL
61 ROLLER HANDLE GRIP
62 ROLLER HANDLE SHAFT
65 CYLINDRICAL ROLLER ELEMENT
66 LADDER
67 LADDER RUNG
68 CHAIR
69 CHAIR BACK
70 PAINT SPREADER SCREEN UNIT
71 TOP EDGE OF PAINT SPREADER SCREEN
72 SIDE BEAM OF PAINT SPREADER SCREEN
73 LOWER EXTENSION OF SIDE BEAM
74 CURVE OF SIDE BEAM EXTENSION
75 BOTTOM EDGE OF SPREADER SCREEN
76 CENTER OF SPREADER SCREEN
80 PAINT PAIL HOOK
81 FLEXIBLE ELEMENT ATTACHED TO PAIL HOOK
82 CLIP ELEMENT ATTACHED TO PAIL HOOK
100 CONTAINER ELEMENT
101 CONTAINER UNIT RESERVOIR
103 TOOL FLANGE
104 SIDE EDGE OF REAR FLANGE
106 NOTCH IN REAR WALL OF CONTAINER
108 VERTICAL TOP UP OF CONTAINER
112 STRAP RETAINER CUTOUT
113 CARPENTER PENCIL HOLE
114 BIGGER TOOL RECEIVING CIRCULAR HOLE
115 LID HOLDING SLOT
117 BAIL HANDLE STOP
118 STOP SUPPORT FLANGE
119 TOOL/PENCIL HOLE
120 PLASTIC MAGNET COVER EXTENSION
122 HANDLE PIVOT HOLE IN FLANGE
125 MAGNET INSERTING TROUGH
128 REAR-SIDE CORNER OF CONTAINER
130 SIDE WALL OF CONTAINER
132 SIDE PORTION OF TOOL FLANGE
133 VERTICAL PORTION OF SIDE FLANGE
135 SIDE WALL OFFSET
136 HORIZONTAL PORTION OF FRONT FLANGE
137 PUTTY KNIFE RECEIVING SLOT
138 INNER EDGE OF PUTTY KNIFE SLOT
140 FRONT WALL OF CONTAINER
141 OUTWARDLY CONVEX PORTION OF FRONT WALL
142 FRONT OUTWARD FLANGE
143 VERTICAL BRUSH GROOMING LIP
144. FRONT TOOL RECEIVING HOLES
145 CENTRAL INDENTATION IN FRONT WALL
146 BRUSH GROOMING LIP TROUGH
148 FRONT-SIDE CORNER
150 FRONT FLANGE VERTICAL PORTION
151 CLOTH HOLDING GROOVE
152 LOWEST POINT OF FRONT FLANGE
153 LOWER PORTION OF CLOTH HOLDER
154 CLOTH HOLDER SUPPORTING WEB
155 PUTTY POCKET
160 REAR WALL OF CONTAINER
161 TEXTURED INNER FACE OF REAR WALL
163 TEXTURED PATTERN OF REAR WALL
165 VERTEX OF PATTERN
166 RADIUSED INNER CORNER OF PATTERN
168 HORIZONTAL LEDGE OF TEXTURED PATTERN
169 VERTICAL FACE OF TEXTURED PATTERN
170 BOTTOM ELEMENT OF CONTAINER
171 FRONT PLANAR SECTION OF BOTTOM
172 RECESSED PAINT WELL FOR ROLLER
173 BOTTOM STIFFENING RIB
174 FLAT SLOPING AREA OF BOTTOM
175 SPREADER SCREEN SUPPORT WEB
176 SPREADER SCREEN RECEIVING SLOT
177 BOTTOM PERIMETER FLANGE
178 CUT OUTS IN BOTTOM FLANGE
179 LOWEST EDGE OF BOTTOM FLANGE
180 OPEN TOP OF CONTAINER
185 TOP EDGE OF SCREEN SUPPORTING WEB
190 BOTTOM BOSS ON CONTAINER
200 LID ASSEMBLY

Figure 15:
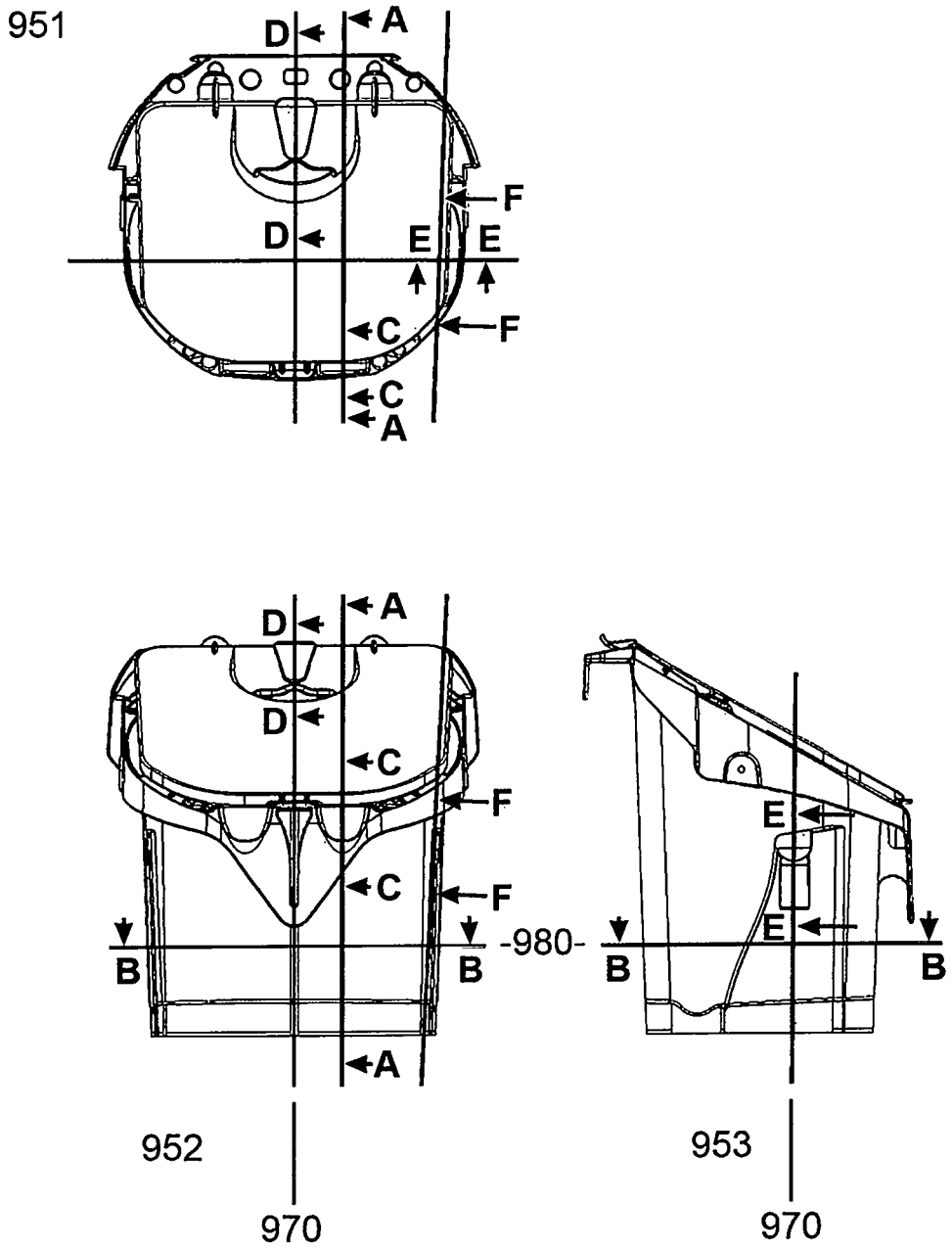
FIG. 15. A three-view drawing showing the locations of the various sectional views used in the figures, the container and lid are shown with the lid closed, forming a containing assembly.

201 LID ELEMENT
202 LID IN REAR STOWAGE POSITION
203 LID OUTER SEALING LIP
204 LID INNER SEALING LIP
205 LID FRONT LIFT TAB
206 NOTCH IN LID
207 SEALING SLOT IN LID
208 LID SLOT BASE
209 LID SEALING SLOT ENTRANCE
210 INNER FACE OF INNER LIP
211 OUTER FACE OF OUTER UP
220 LID SIDE LIFT TAB
225 SIDE CLIP-ON TAB
230 REAR LIFT AND STOWAGE TAB ON LID
233 LID REAR EDGE
250 FLAP CLEARANCE RECESS ON LID
251 OUTER FLAP RECESS IN LID
252 INNER DEEPER FLAP PROTUBERANCE RECESS
260 PIVOT POINT FOR NOTCH SEALING FLAP
300 LID NOTCH COVERING FLAP
301 FLAP IN CLOSED POSITION
302 FLAP IN OPEN POSITION
310 NOTCH COVERING PROTUBERANCE ON FLAP
320 AXIS OF PIVOTING FLAP
321 FLAP PIVOT ELEMENT
400 HANDLE ASSEMBLY
405 BAIL HANDLE ELEMENT
406 BAIL HANDLE SUSPENSION HOOK ATTACHMENT POINT
407 HANDLE PIVOT PRONGS
410 HANDLE GRIP
411 HANDLE GRIP CUT OUT
415 HANDLE PIVOT AXIS
500 MAGNET
505 MAGNET RECEIVER POCKET
510 INNER FACE OF MAGNET AREA
520 OUTER FACE OF MAGNET AREA
530 MAGNET HOLDING EAR
550 MAGNET POCKET
610 LEFT FRONT LEG
611 PIVOT POINT OF FRONT LEFT LEG
612 CIRCULAR LEG SUPPORT FLANGE
613 OUTER DISTAL PORTION OF LEG
615 PIVOT AXIS OF FRONT LEFT LEG
616 LOWERING OF LEFT FRONT LEG
620 LEFT REAR LEG
621 PIVOT POINT OF LEFT REAR LEG
630 RIGHT REAR LEG
631 PIVOT POINT OF RIGHT REAR LEG
. 635 PIVOT AXIS OF RIGHT REAR LEG
636 LOWERING OF RIGHT REAR LEG
640 RIGHT FRONT LEG
641 PIVOT POINT OF RIGHT FRONT LEG
700 STRAP ASSEMBLY
710 STRAP LOOP ADJUSTER SLIDER
720 STRAP LOOP ADJUSTING RING
730 STRAP ATTACHING CLIP
750 LOWER PORTION OF STRAP LOOP
760 UPPER ADJUSTABLE PORTION OF STRAP LOOP
800 REMOVABLE LINER
810 TOP EDGE OF LINER
820 VERTICAL PORTION AT OUTERMOST EDGE OF LINER
850 COLLAR STOP FOR TOOL
851 TROUGH INSIDE HOLE
852 RIDGE INSIDE HOLE
853 CENTRAL HOLE IN COLLAR STOP
854 CYLINDRICAL TOOL
870 OUTER EDGE OF COLLAR STOP
900 TAPE ROLL HOLDER ASSEMBLY
903 ATTACHMENT POINT FOR FLEXIBLE ELEMENT
910 FLEXIBLE ELEMENT OF TAPE ROLL HOLDER
911 FIRST END O FLEXIBLE ELEMENT
912 SECOND END O FLEXIBLE ELEMENT
920 FERRIS FOB ELEMENT OF TAPE ROLL HOLDER
951 TOP VIEW OF INVENTION, FIG. 15
952 FRONT VIEW OF INVENTION, FIG. 15
953 SIDE VIEW OF INVENTION, FIG. 15

What is claimed is:

1. An improved method for applying and storing surface coating materials comprising:

(a) putting a first portion of surface coating material into a container, said container having an open top, an open top angle being measured between a plane of the open top and horizontal (b) transporting said container, a quantity of surface coating material and a first application tool to a first location, said first application tool having a handle section and a wettable part (c) wetting said wettable part of said first application tool with surface coating material and applying said surface coating material to a first surface proximal to said first location with said first application tool (d) having a remaining portion of said surface coating material within said container (e) securing said first application tool by securing means provided on said container, said securing means permitting said handle section of said first application tool to be supported clear of said remaining portion of said surface coating material when said container rests in a normal upright position; said securing means being selected from among the group consisting of: internally stored handle securing means, and externally stored handle securing means (f) fitting a lid to said container forming a containing assembly, said containing assembly enclosing said remaining portion of said surface coating material and said wettable part of said first application tool, said handle section of said first application tool being clear of said remaining portion of the surface coating material; said lid and said first application tool being distinct from each other; a seam being formed where said lid joins to said container, said seam having a substantially vapor tight sealing function;

additionally, internally stored handle securing means comprising having said handle section of said application tool enclosed within said containing assembly when said lid is fitted, said internally stored handle securing means additionally providing convenient access, when said lid is off, through said open top, to said handle section;

additionally, externally stored handle securing means comprising storing said handle section of said first application tool in a location external to said containing assembly when said lid is fitted, said application tool extending through a hole in said containing assembly, said hole being of predetermined dimensions, additionally said hole being located on said seam between said lid and said container (g) transporting said containing assembly to a suitable storage location (h) storing said containing assembly and contents for a period of time (i) removing said lid from said container (j) applying a second portion of said remaining portion of said surface coating material to a second surface with said first application tool whereby a quantity of surface coating material may be sequentially applied to the surfaces over a period of time without having to remove the coating material from the container or having to wash the application tools, thereby saving time and materials, and whereby the handle portions of tools remain clean of coating material during transport and storage, and whereby the lid can be fitted with the application tool already in storage position, a position where the tool is readily available for use when the lid is off.

2. The method of claim 1 wherein said first application tool is selected from the group consisting of: paint roller tools, and paintbrushes, and sponge tools, and faux finish rag tools, and spatulas, and spreading tools.

3. The method of claim 1 wherein said surface coating material is latex paint, and said suitable storage location is free of strong drafts and has room temperature conditions averaging approximately 40 to 70 degrees Fahrenheit, and the period of storage time between uses of said first application tool ranges from a few minutes to a period of approximately six months.

4. The method of claim 1, wherein securing said first application tool to said containing assembly is accomplished by magnetic means.

5. The method of claim 1, wherein said lid engages said container by moving downward in a substantially vertical direction, at least one downward lip on said lid making sliding contact with an upwardly protruding lip on said container.

6. The method of claim 5, wherein an inner lip and an outer lip on said lid engage either side of said upwardly protruding lip on said container, said upwardly protruding lip having the form of a generic cylinder, the defining sweeping direction of said generic cylinder being substantially vertical, whereby the lid slides off and on along the defining direction and a container part may be ejected from a zero draft section of a mold along the defining axis regardless of an angle of the top opening.

7. The method of claim 1 additionally comprising: transporting and using a plurality of additional tools in conjunction with said first application tool, said transporting being accomplished by tool holding means on the container.

8. The method of claim 1, wherein said first application tool is selected from a group consisting of: paint rolling tools and tools having a substantially cylindrical shaft section; said first application tool having a handle, an intermediate shaft section of a first predetermined size and a wettable section;

and further comprising: positioning said first application tool in a notch of a second predetermined size provided in said lid; said first predetermined size and said second predetermined size allowing said intermediate shaft section to fit closely in said notch clot; and allowing said handle of said first application tool to protrude from said containing assembly while said wettable section of the tool is enclosed within said containing assembly; the first predetermined size and the second predetermined size resulting in a fit providing a substantially vapor tight seal for the containing assembly;

whereby said wettable section of the tool is prevented from drying out during storage and the tool handle is not in contact with the contained coating material.

9. The method of claim 8, wherein said notch is provided with a moveable cover, whereby the containing assembly can be sealed against evaporation of contents more effectively when no tool shaft or handle is in the notch.

10. The method of claim 9, wherein said moveable cover is captive and pivots about a predetermined axis on said containing assembly.

11. The method of claim 9, wherein said moveable cover is captive and is attached to said containing assembly by a flexible element.

12. The method of claim 1 additionally comprising temporarily attaching said lid to said container exterior in a stowage location, said stowage location being different from the position occupied by said lid when forming said containing assembly, whereby the lid is immediately available to seal up the container and the lid is less likely to get lost.

13. The method of claim 1 wherein said container is transported to said first location by means of a detachable strap assembly, whereby a person may transport materials and equipment with hands free.

14. The method of claim 1 additionally comprising utilizing said container at said first location while said container is carried by a person by means of a detachable strap assembly, whereby a person may have hands free to use application tools or support themselves.

15. The method of claim 1 additionally comprising temporarily attaching said container to a supporting element selected from the group consisting of: ladders, and scaffolding, and doors, and chairs, and fences, and knobs, and hooks, and lanyards; thereby positioning and stabilizing the container in a convenient position for use.

16. The method of claim 1 additionally comprising installing a liner in said container prior to putting the surface coating material into the container, said liner being of predetermined thickness, said liner being configured to allow substantially normal operation of the lid and permitting formation of a containing assembly with liner installed, whereby the liner may be optionally used and removed to facilitate color change or clean out.

17. The method of claim 16 wherein said liner is constructed of thin flexible plastic material of predetermined thickness, said predetermined thickness of said liner being sufficiently thick to resist puncture in normal use, yet sufficiently thin to fit between said container and said lid when said containing assembly is formed, thereby allowing optional use of a liner with the lid and the container.

18. The method of claim 1 wherein transporting said containing assembly to said suitable storage location additionally comprises placing said containing assembly into the interior of a standard 5 gallon paint pail.

19. The method of claim 1 additionally comprising adding a quantity of thinning liquid to said container prior to installing said lid and forming said containing assembly, whereby said remaining portion of said surface coating material is further protected from drying out, wherein water can be used as a thinning liquid with latex paint.

20. An improved apparatus for applying and storing surface coating materials comprising:

(a) a transportable container with an open top, said transportable container being capable of holding a quantity of surface coating material and at least one application tool, said application tool having a handle section and a wettable section, said transportable container having an interior and an exterior, and said transportable container having a bottom part providing means of supporting the container and providing stability when said transportable container sits normally on a substantially flat and level surface (b) a lid of predetermined shape and size, said lid being configured to fit over said open top of said transportable container (c) a containing assembly formed by the joined combination of said container and said lid, said containing assembly being substantially vapor-tight and said containing assembly being configured to prevent the drying out of any enclosed surface coating material when the assembly is stored in a suitable location for a period of time, a seam being created between said lid and said transportable container when said containing assembly is formed (d) a first securing means for supporting said application tool in a manner which allows said wettable section of said application tool to be enclosed within the substantially vapor-tight containing assembly, said first securing means additionally positioning said handle section of said application tool such that said handle section is clear of any surface coating material that is within said containing assembly when the assembly is sitting normally, said first securing means additionally comprising handle storage means selected from among the group consisting of: internally stored handle means, wherein said handle section of said application tool is enclosed within said containing assembly when said lid is installed, said internally stored handle means additionally providing convenient access, when said lid is off, to said handle section, and externally stored handle means, wherein said handle section of said application tool is external to said containing assembly when said lid is fitted, said application tool extending through a hole in said containing assembly, said hole being of predetermined dimensions, additionally said hole being intersected by said seam between said lid and said transportable container (e) transporting means providing for convenient movement of the container from location to location by a person whereby the lid can be installed with the application tool already in storage position, and whereby surface coating material may be efficiently stored and applied to diverse surfaces over a period of time without having to remove the coating material from the container or having to wash application tools, thereby saving time and materials.

21. The apparatus of claim 20 wherein said open top is inclined to the horizontal at an angle of up to approximately 45 degrees, whereby easier access is provided to the surface coating material inside.

22. The apparatus of claim 20 wherein said first securing means are magnetic means of temporarily attaching said application tool to said containing assembly.

23. The apparatus of claim 22 wherein said magnetic means comprise an individual magnetic element, said individual magnetic element being configured and placed in a region where magnetically attractable objects may be held on both said interior of the container and said exterior of the container, whereby wet paintbrushes may be held inside the container and dry scraping tools on the outside by the same magnet at the same time.

24. The apparatus of claim 23 additionally comprising a lineal flexible element terminating in a magnetically attractable section at a first end, and being attached to said transportable container at a second end; said magnetically attractable section being detachably attachable to said individual magnetic element, said lineal flexible element having some slack when said magnetically attractable end is attached to the magnet, whereby a roll of tape may be transported by putting the attractable end of the lineal element through the roll and attaching the end to the magnet.

25. The apparatus of claim 20 wherein said application tool has a handle section, an intermediate shaft section and a wettable section;

and the apparatus additionally comprising a notch of a predetermined size provided in said lid; the predetermined size being suitable for allowing through passage of the shaft section of said application tool and providing a substantially vapor tight seal therewith, whereby said wettable section of said application tool can be enclosed within said containing assembly and protected from drying out while said handle section of said application tool is exterior to said containing assembly.

26. The apparatus of claim 25 additionally comprising a moveable cover for said notch, said moveable cover being capable of blocking said notch in said lid when no tool handle is therein, said moveable cover providing a substantially vapor tight sealing of the containing assembly, whereby surface coating material may be stored inside said containing assembly and be protected from drying out for periods of time when no tool handle is occupying the notch.

27. The apparatus of claim 26, wherein said moveable cover is captive and pivots about a predetermined axis.

28. The apparatus of claim 26, wherein said moveable cover is captive and is attached to said containing assembly by a flexible element.

29. The apparatus of claim 20 wherein additionally said lid is configured to temporarily attach to said exterior of said transportable container in a stowage location, said stowage location being different from the position occupied by said lid when forming said containing assembly, whereby the lid can be easily kept with the container and is immediately available to seal up the container, also whereby the lid is less likely to get misplaced or lost.

30. The apparatus of claim 29 wherein said lid has extensions configured to fit within receiving elements on the exterior of said transportable container when said lid is installed in said stowage location.

31. The apparatus of claim 20 additionally comprising a detachable strap assembly allowing a person to carry said transportable container without gripping it in their hands, whereby the person may have hands free to use application tools, support themselves, or perform other actions.

32. The apparatus of claim 20 additionally comprising means of temporarily attaching said transportable container to a supporting element selected from the group consisting of: ladders, and scaffolding, and doors, and fences, and knobs, and hooks, and lanyards; thereby allowing the container to be positioned and stabilized in a convenient position when in use.

33. The apparatus of claim 32 wherein said means of temporarily attaching said transportable container to a supporting element comprises a mechanism selected from the group consisting of: hooks, and clips, and flange extensions of predetermined shape.

34. The apparatus of claim 20 additionally comprising a plurality of tool receiving extensions around the exterior of said container, whereby tools may be transported and used in conjunction with said transportable container.

35. The apparatus of claim 34 additionally comprising at least one tool stop toroid, said tool stop toroid being constructed of elastic material and of predetermined size and shape, said predetermined size and shape being such that the tool stop securely engages a shaft of a substantially cylindrical tool section, said tool stop being of sufficient size and shape to engage said tool receiving extensions on said transportable container, whereby a tool stop around said cylindrical tool section can prevent the tool from sliding past said tool receiving extensions on the container.

36. The apparatus of claim 20 wherein said application tool is selected from the group consisting of: paint roller tools, and paintbrushes, and sponge tools, and faux finish rag tools, and spatulas, and spreading tools.

37. An improved apparatus for applying and transporting surface coating materials comprising:

(a) a transportable container with an open top, said transportable container being capable of holding a quantity of surface coating material and at least one application tool, said application tool having a handle section and a wettable section, said transportable container having an interior and an exterior, and said transportable container having a bottom part providing means of supporting the container and providing stability when said transportable container sits normally on a substantially flat and level surface (b) multifunctional magnetic means for supporting said application tool in a manner which provides easy access to said handle section of said first application tool and said manner allowing said wettable section of said application tool to drain back into said interior of said transportable container when the container is sitting normally, said multifunctional means additionally providing temporary magnetic securing of magnetically attractable items on said exterior of said container, whereby a wet application tool can be temporarily secured inside the container and a dry article temporarily attached on the outside by the same magnetic means, (c) transporting means providing for convenient movement of the container from location to location by a person, whereby multiple tools may be secured by a single magnet during transport and between uses.

38. The apparatus of claim 37 wherein a wall section forms part of said transportable container, and said multifunctional magnet means comprise at least one magnet incorporated into said wall section of said transportable container, said magnet being positioned in said wall section so that magnetically attractable objects may come in close proximity to said magnet without being impeded by other material in said wall section, whereby getting closer to the magnet provides stronger magnetic attraction for the tool or other item.

* * * * *